US011098954B2

(12) United States Patent
Fuller

(10) Patent No.: US 11,098,954 B2
(45) Date of Patent: Aug. 24, 2021

(54) HEAT EXCHANGER

(71) Applicant: CONFLUX TECHNOLOGY PTY LTD, Forrest (AU)

(72) Inventor: Michael Fuller, Forrest (AU)

(73) Assignee: CONFLUX TECHNOLOGY PTY LTD, Forrest (AU)

( * ) Notice: Subject to any disclaimer, the term of this patent is extended or adjusted under 35 U.S.C. 154(b) by 369 days.

(21) Appl. No.: 15/743,183

(22) PCT Filed: Jul. 8, 2016

(86) PCT No.: PCT/AU2016/050598
§ 371 (c)(1),
(2) Date: Jan. 9, 2018

(87) PCT Pub. No.: WO2017/008108
PCT Pub. Date: Jan. 19, 2017

(65) Prior Publication Data

US 2019/0120562 A1 Apr. 25, 2019

(30) Foreign Application Priority Data

Jul. 10, 2015 (AU) ..... 2015902728

(51) Int. Cl.
*F28D 7/16* (2006.01)
*F28F 1/04* (2006.01)
(Continued)

(52) U.S. Cl.
CPC ..... *F28D 7/1669* (2013.01); *F28D 7/1684* (2013.01); *F28F 1/04* (2013.01);
(Continued)

(58) Field of Classification Search
CPC ..... F28D 7/1669; F28D 7/1684; F28D 7/103; F28D 7/163; F28F 1/04; F28F 1/40;
(Continued)

(56) References Cited

U.S. PATENT DOCUMENTS 6,244,333 B1 * 6/2001 Bergh ..... B01J 19/0093 165/157
8,925,624 B2 * 1/2015 Kuroyanagi ..... F28F 9/026 165/157

(Continued)

FOREIGN PATENT DOCUMENTS

| | | |
|---|---|---|
| CN | 2290016 Y | 9/1998 |
| CN | 201917256 U | 8/2011 |
| GB | 1462537 A | 1/1977 |

OTHER PUBLICATIONS

International Search Report and Written Opinion, International Application No. PCT/AU2016/050598, dated Sep. 16, 2016, 14 pages.

*Primary Examiner* — Joel M Attey
(74) *Attorney, Agent, or Firm* — Quarles & Brady LLP

(57) ABSTRACT

A heat exchanger for transferring thermal energy between a first working fluid and a second working fluid. The heat exchanger has an outer shell that has a first port, a second port, a third port, and a fourth port. A set of tubes each extend within the outer shell and between the first and second ports, such that the first working fluid can flow in parallel through the tubes. A plenum space extends within the outer shell and between the third and fourth ports, and surrounding the tubes. The second working fluid is to flow through the plenum space. The heat exchanger has a central core region, a first transition region that extends between the first port and the central core region, and a second transition region that extends between the second port and the central core region.

17 Claims, 30 Drawing Sheets

(51) Int. Cl.

| | |
|---|---|
| ***F28F 9/02*** | (2006.01) |
| ***F28F 9/00*** | (2006.01) |
| ***F28F 1/40*** | (2006.01) |
| ***F28F 1/42*** | (2006.01) |
| ***F28F 13/08*** | (2006.01) |
| *F28D 7/10* | (2006.01) |

(52) U.S. Cl.
CPC ..... *F28F 1/40* (2013.01); *F28F 1/422* (2013.01); *F28F 9/00* (2013.01); *F28F 9/0268* (2013.01); *F28F 9/0275* (2013.01); *F28F 13/08* (2013.01); *F28D 7/103* (2013.01); *F28D 7/163* (2013.01); *F28F 9/002* (2013.01); *F28F 2009/029* (2013.01)

(58) Field of Classification Search
CPC .. F28F 1/422; F28F 9/00; F28F 9/0268; F28F 9/0275; F28F 9/002; F28F 13/08; F28F 2009/029
USPC ..... 165/157
See application file for complete search history.

(56) References Cited

U.S. PATENT DOCUMENTS

| | | | | |
|---|---|---|---|---|
| 2003/0070793 | A1* | 4/2003 | Dierbeck ..... | F28F 1/42 165/145 |
| 2008/0073059 | A1 | 3/2008 | Weel | |
| 2014/0158320 | A1 | 6/2014 | Archer et al. | |

* cited by examiner

HEAT EXCHANGER

PRIORITY CLAIM

This application claims priority to PCT Patent Application No. PCT/AU2016/050598, filed on Jul. 8, 2016, which is incorporated herein by reference in its entirety.

FIELD OF THE INVENTION

The present invention relates to a heat exchanger.

BACKGROUND

It is known to use heat exchangers to cool lubricating and cooling liquids (hereinafter referred to generally as "working fluids"). Many engines and encased driveline components use lubricating and cooling liquids to reduce internal friction and optimize performance. For example, internal combustion engines use an engine oil in the crank case to lubricate the big-end bearings on the crank shaft, and also the piston/cylinder surfaces. The temperature within the engine increases with increasing load and/or engine speed. To keep the engine operating optimally, the engine oil must be cooled. Similarly, with regard to other driveline components.

A radiator is a commonly used heat exchanger in automotive applications to transfer heat from a working fluid to air that passes through the radiator. While working fluid-to-air heat exchange devices can be effective, the heat transfer from the working fluid to the air can be unpredictable due to high variations in air temperature and humidity, and air flow rate through the radiator. The variation in heat transfer can adversely affect the temperature of working fluid being returned to the component. In high performance engines and vehicles, there is a need to control the temperature of working fluids accurately to maximize performance. A cooling system in a high performance application can include an additional heat exchanger that transfers heat from the working fluid to a coolant liquid. The coolant liquid can then be cooled separately using a radiator. Although this type of cooling system is more elaborate, the temperature of the working fluid can be more accurately controlled.

A heat exchanger that has a relatively high heat transfer surface area to volume ratio can be referred to as a "compact heat exchanger". A compact heat exchanger is typically assessed by a number of performance properties, including the inlet and outlet working fluid temperature difference, the working fluid flow rate through the exchanger, inlet and outlet working fluid pressure difference.

In addition, in high performance applications (such as in the automotive field), the overall mass of the heat exchanger is a significant factor, as this impacts fuel consumption, vehicle inertia and acceleration.

There is a need to improve on existing heat exchangers, and/or at least provide a useful alternative.

SUMMARY OF THE INVENTION

The present invention provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, such that the first working fluid can flow in parallel through the tubes; and a plenum space through which the second working fluid is to flow, the plenum space extending within the outer shell and between the third and fourth ports, and surrounding the tubes, wherein the heat exchanger has a central core region, a first transition region that extends between the first port and the central core region, and a second transition region that extends between the second port and the central core region, and wherein, for at least some of the tubes, the cross-sectional area of each tube varies between the first and second ports.

In some embodiments, the cross-sectional area of each tube is greater within the central core region than the cross-sectional area of the respective tube adjacent the respective first and second ports.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, such that the first working fluid can flow in parallel through the tubes; and a plenum space through which the second working fluid is to flow, the plenum space extending within the outer shell and between the third and fourth ports, and surrounding the tubes, wherein the heat exchanger has a central core region, a first transition region that extends between the first port and the central core region, and a second transition region that extends between the second port and the central core region, and wherein the first working fluid enters the heat exchanger through the first port in a first direction and at least some of the tubes are shaped within the first transition region such that the first working fluid flows outwardly with respect to the first direction, and/or wherein the first working fluid exits the heat exchanger through the second port in a second direction and at least some of the tubes are shaped within the second transition region such that the fluid flows inwardly with respect to the second direction.

Preferably, the flow of the first working fluid in each of the first and second transition regions includes a radial component relative to the respective first and second directions.

In at least some embodiments, the first and second directions are parallel. Preferably, the first and second ports are configured such that the first working fluid flows coaxially into and out of the heat exchanger.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, each tube defining a first working fluid flow path through which the first working fluid is to flow; and a plenum space through which the second working fluid is to flow, the plenum space extending within the outer shell and between the third and fourth ports, and surrounding the tubes, wherein at least some tubes include at least one first portion that has one or more fins that each project from one of the tube walls into the respective working fluid flow path, and one or more second portions in which the surfaces of the tube walls that face the respective first working fluid flow paths are substantially inwardly concave.

In embodiments in which the heat exchanger has a central core region, a first transition region that extends between the first port and the central core region, and a second transition region that extends between the second port and the central core region, the at least one first portion can extend at least partly within the central core region, and each of the second portions can extend within a respective one of the first and second transition regions.

In some embodiments, the fins have a generally serpentine configuration and are generally elongate with respect to the first working fluid flow paths. Alternatively, the fins can extend parallel to the respective first working fluid flow path.

Preferably, the fins are arranged in sets of fins, wherein the fins in adjacent sets are spaced apart in the direction of the respective first working fluid flow path.

At least some of the fins have a castellated structure along their length. In other words, at least some of the fins include one or more parapet formations disposed at intervals along the length of the respective fin, and wherein the respective fin has a crenel formation on at least one side of each parapet formation.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, each tube defining a first working fluid flow path through which the first working fluid is to flow; and a plenum space through which the second working fluid is to flow, the plenum space extending within the outer shell and between the third and fourth ports, and includes fluid conduits that each at least partly surround at least one of the tubes, each fluid conduit defining a second working fluid flow path, wherein at least some tubes include at least one first portion that has one or more fins that each project from one of the tube walls into the second working fluid flow paths, and one or more second portions in which the surfaces of the tube walls that face the respective second working fluid flow paths are substantially outwardly convex.

In embodiments in which the heat exchanger has a central core region, a first transition region that extends between the first port and the central core region, and a second transition region that extends between the second port and the central core region, the at least one first portion can be provided in the central core region, and each of the second portions can be provided in a respective one of the first and second transition regions.

In some embodiments, the fins have a generally serpentine configuration and are generally elongate with respect to the first working fluid flow paths. Alternatively, the fins can extend parallel to the respective second working fluid flow path.

Preferably, the fins are arranged in sets of fins, wherein the fins in adjacent sets are spaced apart in the direction of the respective second working fluid flow path.

At least some of the fins have a castellated structure along their length. In other words, at least some of the fins include one or more parapet formations disposed at intervals along the length of the respective fin, and wherein the respective fin has a crenel formation on at least one side of each parapet formation.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, each tube defining a first working fluid flow path through which the first working fluid is to flow; and a plenum space through which the second working fluid is to flow, the plenum space extending within the outer shell and between the third and fourth ports, and including fluid conduits that each at least partly surround at least one of the tubes, each fluid conduit defining a second working fluid flow path, wherein the outer shell forms a portion of the tube wall for at least some of the tubes in a region that is adjacent the first port.

In at least some embodiments, the outer shell also forms a portion of the tube wall for at least some of the tubes in a region that is adjacent the second port.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, each tube defining a first working fluid flow path through which the first working fluid is to flow; and a plenum space through which the second working fluid is to flow, the plenum space extending within the outer shell and between the third and fourth ports, and including fluid conduits that each at least partly surround at least one of the tubes, each fluid conduit defining a second working fluid flow path, wherein at least some of the fluid conduits are defined by the outer shell.

In embodiments in which the heat exchanger has a central core region, the outer shell defines the respective fluid conduits in the central core region.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, each tube defining a first working fluid flow path through which the first working fluid is to flow;

a plenum space through which the second working fluid is to flow, the plenum space extending within the outer shell and between the third and fourth ports, and including fluid conduits that each at least partly surround at least one of the tubes, each fluid conduit defining a second working fluid flow path; and in a region that is adjacent the first port, one or more tube dividing walls that each form a tube wall for one or more of the tubes.

In at least some embodiments, the heat exchanger further comprises one or more tube dividing walls that each form a tube wall for one or more of the tubes in a region that is adjacent the second port.

The tube dividing walls can include one or more annular tube dividing walls. In certain embodiments, each of the annular tube dividing walls has a circular cross section. Preferably, the annular tube dividing walls are concentric.

Alternatively or additionally, the tube dividing walls can include one or more radial tube dividing walls.

In at least one embodiment, each tube dividing wall extends between two or more first working fluid flow paths.

Preferably, the tube dividing walls terminate flush with the outer shell at the first and/or second ports.

In certain embodiments, the heat exchanger can include an innermost annular tube dividing wall that defines an inner first working fluid flow path that has a generally circular cross section. Preferably, the innermost annular tube dividing wall extends through the exchanger from the first port to the second port.

In embodiments in which the heat exchanger has first and second transition regions, and each tube dividing wall cleaves (in other words, "separates", "divides", or "splits") within the respective first or second transition region, such that within the central core region the tube walls of each first working fluid flow path are exclusive to that first working fluid flow path.

In at least some embodiments, the heat exchanger further comprises bridging elements that are joined to walls of one or more of the tubes, and separates adjacent fluid conduits.

In at least some embodiments, the heat exchanger further comprises one or more conduit dividing walls that each form a wall for one or more of the fluid conduits in the central core region.

The heat exchanger can further comprise bridging members that each space the tube walls within the respective fluid conduits. In some instances, the bridging members each extend between one of the conduit dividing walls and one of the tube walls. In some other instances, the bridging members extend between one of the tube walls and the outer shell.

Within the central core region, the heat exchanger can include an innermost fluid conduit that surrounds the inner first working fluid flow path. In some embodiments, the heat exchanger can include a plurality of rings that each consist of tubes and fluid conduits, wherein the rings surround the inner first working fluid flow path and innermost fluid conduit.

In at least some embodiments, within the central core region, the heat exchanger includes a first ring of tubes and fluid conduits that surrounds the inner first working fluid flow path and innermost fluid conduit. Further, within the central core region, the heat exchanger can include a second ring of tubes and fluid conduits that surrounds the first ring. Further yet, within the central core region, the heat exchanger can include a third ring of tubes and fluid conduits that surrounds the second ring.

The present invention alternatively or additionally provides a heat exchanger for transferring thermal energy between a first working fluid and a second working fluid, the heat exchanger comprising:

an outer shell that has a plurality of openings that include a first port, a second port, a third port, and a fourth port;

a set of tubes that each extend within the outer shell and between the first and second ports, such that the first working fluid can flow in parallel through the tubes;

a plenum space through which the second working fluid is to flow, the plenum space extending within the outer shell and between the third and fourth ports, and including a first manifold that is in communication with the third port, a second manifold that is in communication with the fourth port, and fluid conduits that each at least partly surround at least one of the tubes, each fluid conduit defining a second working fluid flow path that extends between the first and second manifolds and through a central core region of the heat exchanger;

one or more conduit dividing walls in the central core region, each conduit dividing wall forming a wall for one or more of the fluid conduits; and buttress supports that each connect one of the tube walls to an end of at least one of the conduit dividing walls.

The conduit dividing walls can include one or more annular conduit dividing walls and one or more radial conduit dividing walls, wherein the annular conduit dividing walls and radial conduit dividing walls intersect, and wherein the buttress supports each connect to intersections of the annular conduit dividing walls and radial conduit dividing walls.

Preferably, two or more buttress supports connect to each intersection of one of the annular conduit dividing walls and one of radial conduit dividing walls. In some instances, four buttress supports connect to at least some of the intersections of one of the annular conduit dividing walls and one of radial conduit dividing walls.

In certain embodiments, each of the annular conduit dividing walls has a circular cross section. Preferably, the annular conduit dividing walls are concentric.

Preferably, the plenum space includes a first manifold that is between the third port and a first end of the fluid conduits, wherein the first manifold surrounds a portion of the tubes. More preferably, the plenum space further includes a second manifold that is between the fourth port and a second end of the fluid conduits, wherein the second manifold surrounds another portion of the tubes.

The heat exchanger can include a connecting member at any one or more of: the first port, the second port, the third port, and the fourth port, wherein the or each connecting member is to mate with a tube piece. The or each connecting member can be in the form of a pair of spaced apart annular rings between which an O-ring can be positioned.

In some embodiments, each of the first and second ports includes a neck.

Preferably, the outer shell includes a stem that extends between the third port and the first manifold, and/or a stem that extends between the fourth port and the second manifold.

In some embodiments, the outer shell in the central core region has a generally cylindrical shape. In some alternative embodiments, the outer shell in the central core region has a prism shape.

Preferably, the outer shell narrows from the central core region towards each of the first and second ports.

In embodiments in which the central core region has a generally circular cylindrical shape, the portions of the outer shell surrounding the first and second manifolds preferably has the shape of an S-curve rotated about the longitudinal axis of the central core region.

In at least some embodiments, the first and second ports are positioned in the outer shell such that flow of the first working fluid through the first and second ports is parallel and/or coaxial.

Preferably, the outer shell is a unitary component of a jointless and/or seamless construction. More preferably, the heat exchanger is a unitary component of a jointless and/or seamless construction.

In some applications, the heat exchanger can be plumbed such that the first working fluid flows through the heat exchanger between the first and second ports, and the second working fluid flows through the heat exchanger between the third and fourth ports. In other applications, the heat exchanger can be plumbed such that the first working fluid flows through the heat exchanger between the third and fourth ports, and the second working fluid flows through the heat exchanger between the first and second ports.

In certain embodiments, the heat exchanger is a compact heat exchanger.

BRIEF DESCRIPTION OF THE DRAWINGS

In order that the invention may be more easily understood, an embodiment will now be described, by way of example only, with reference to the accompanying drawings, in which.

DETAILED DESCRIPTION

Figure 1:
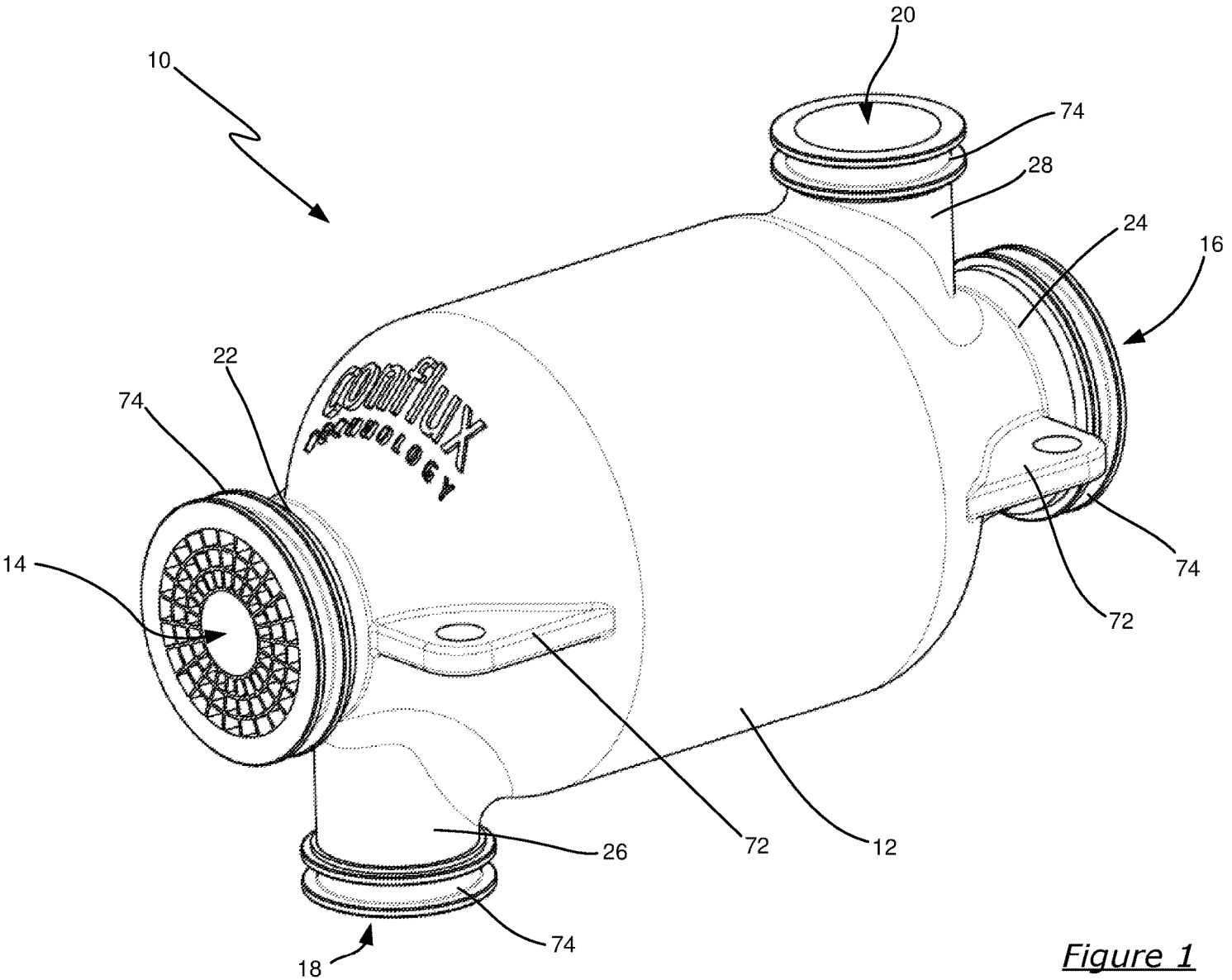
FIG. 1: is a perspective view of a compact heat exchanger in accordance with a first embodiment of the present invention.

FIGS. 1 to 18 show a compact heat exchanger 10 in accordance with an embodiment of the present invention. In use, the heat exchanger 10 is to transfer thermal energy between a first working fluid and a second working fluid. For simplicity in the description that follows, the first working fluid is referred to simply as "working fluid", and the second working fluid is referred to as "coolant".

The heat exchanger 10 has an outer shell 12 that has a plurality of openings that include a first working fluid port 14, a second working fluid port 16, a first coolant port 18, and a second coolant port 20. A working fluid that is to be cooled or heated can flow into heat exchanger 10 via the first working fluid port 14 and exit the heat exchanger 10 via the second working fluid port 16, or vice versa. A coolant that is to be used in the heat exchange can flow into heat exchanger 10 via the first coolant port 18 and exit the heat exchanger 10 via the second coolant port 20, or vice versa. Thus, in the illustrated embodiment the heat exchanger 10 can be plumbed to operate with parallel flow of working fluid and coolant, or to operate with counter flow of working fluid and coolant.

A set of tubes extend within the outer shell 12 and between the first and second working fluid ports 14, 16, such that working fluid can flow in parallel through the tubes. The structure of the tubes of this embodiment will be discussed in further detail below.

A plenum space, through which coolant is to flow, extends within the outer shell 12 and between the first and second coolant ports 18, 20. The plenum space surrounds the tubes such that thermal energy can be transferred between the two working fluids. The plenum space, and its structure will be discussed in further detail below.

Figure 2:
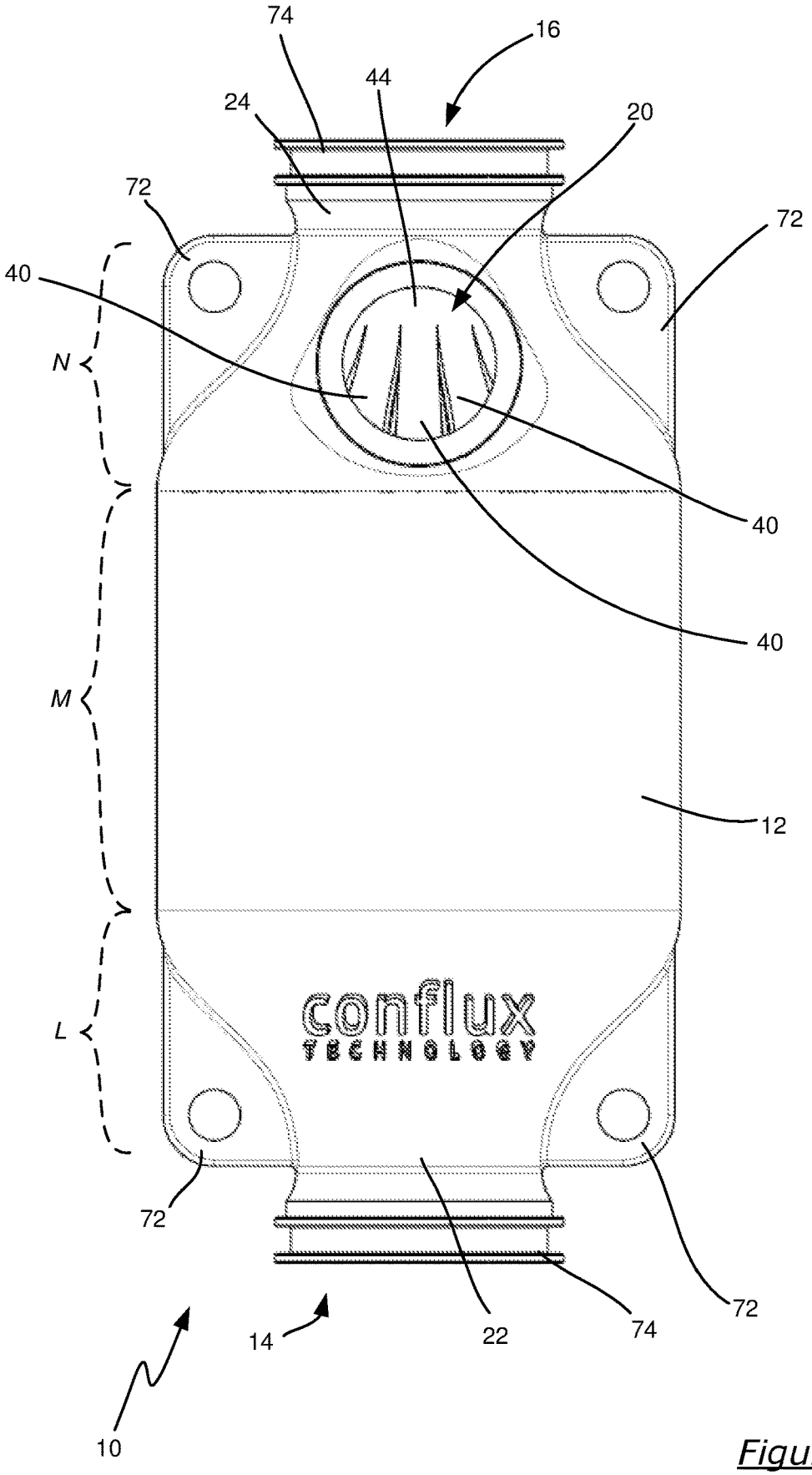
FIG. 2: is a top view of the compact heat exchanger of FIG. 1.
Figure 3:
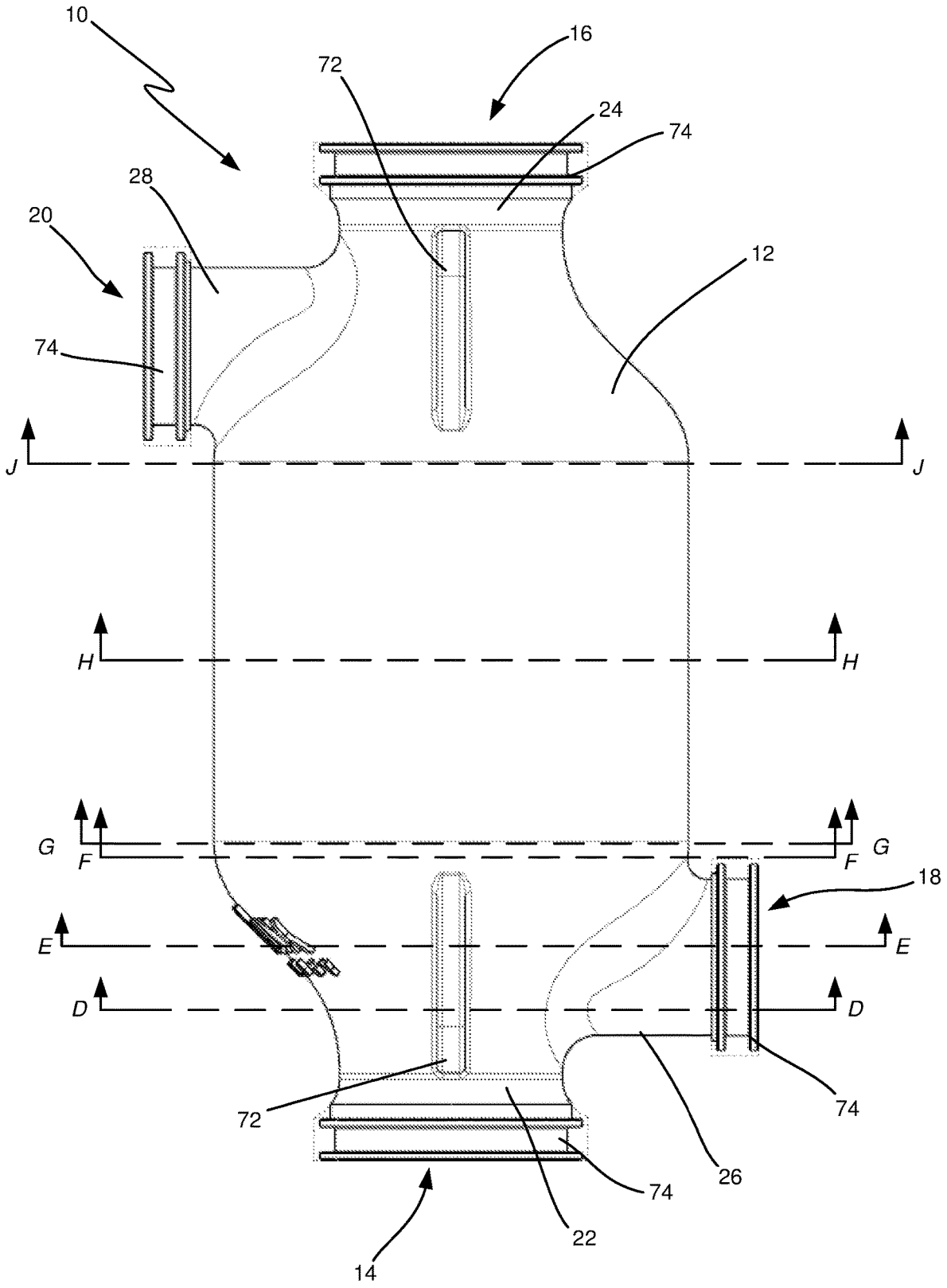
FIG. 3: is a side view of the compact heat exchanger of FIG. 1.
Figure 4:
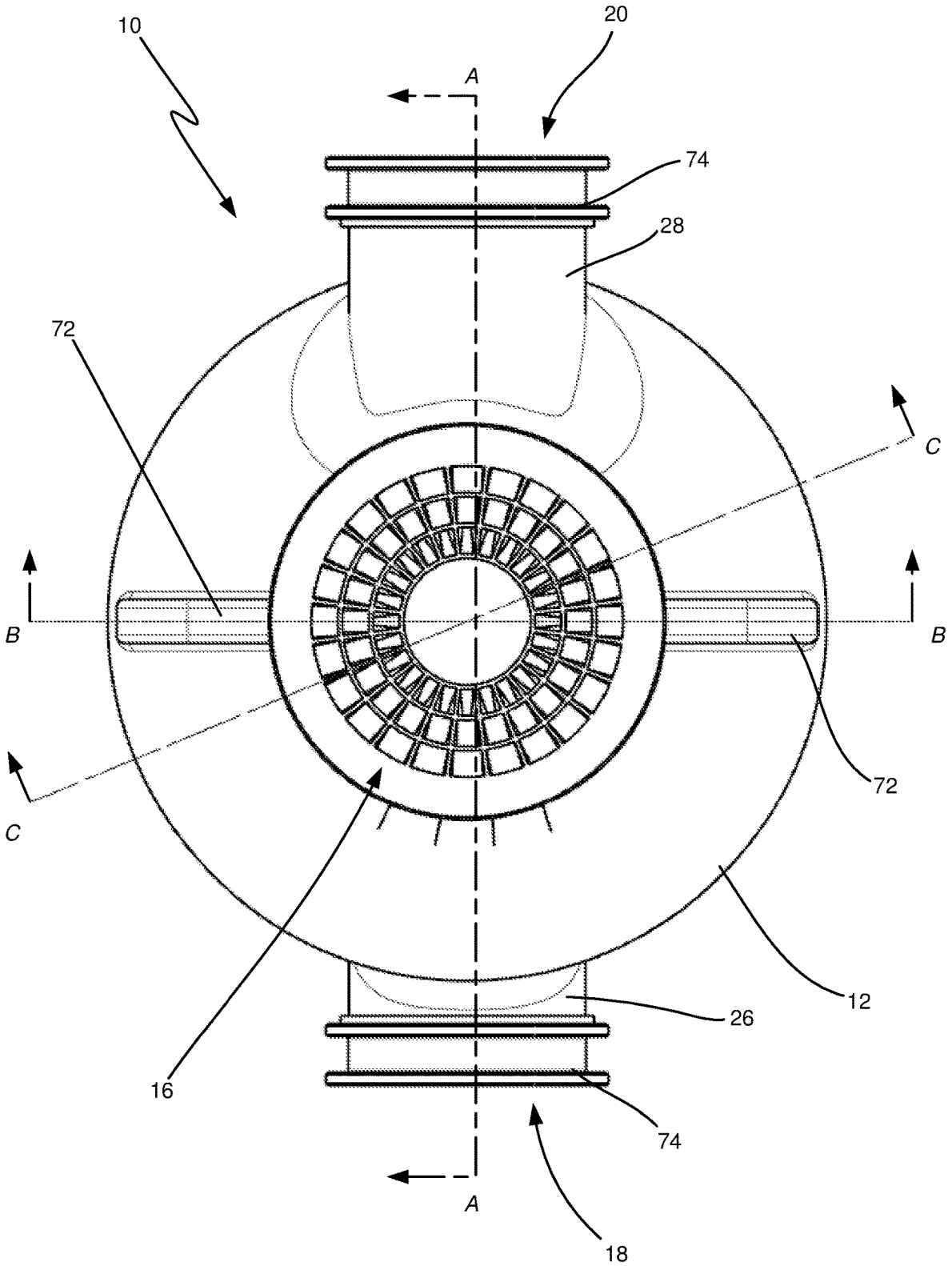
FIG. 4: is an end view of the compact heat exchanger of FIG. 1.

As shown in FIG. 2 in this embodiment, the heat exchanger 10 has a central core region (indicated by curly brackets "M" in FIG. 2), a first transition region (indicated by curly brackets "L" in FIG. 2) that extends between the first working fluid port 14 and the central core region M, and a second transition region (indicated by curly brackets "N" in FIG. 2) that extends between the second working fluid port 16 and the central core region.

In the embodiment illustrated in FIGS. 1 to 18, the first working fluid port 14 includes a neck portion 22 of the outer shell 12, and the second working fluid port 16 includes a neck portion 24 of the outer shell 12. In each of the first and second transition regions L, N, the diameter of the shell increases from the respective neck 22, 24 towards the central core region M. The central core region M is substantially cylindrical.

Further, the outer shell 12 includes a stem 26 within the first transition region L, the stem 26 directs coolant received (or discharged) from the first coolant port 18 into the exchanger 10. Similarly, the outer shell 12 includes a stem 28 within the second transition region N, the stem 28 directs coolant discharged (or received) from the second coolant port 20 out of the exchanger 10.

Structure of Tubes:

In this particular embodiment, there are seventy three (73) tubes that each define a working fluid flow path through the heat exchanger 10. These tubes are arranged into:

- an innermost tube 30;
- an inner set of twenty four (24) tubes 32 that are arranged in a first ring 34 around the innermost tube 30;
- an intermediate set of twenty four (24) tubes 36 that are arranged in a second ring 38 around the first ring 34; and
- an outer set of twenty four (24) tubes 40 that are arranged in a third ring 42 around the second ring 38.

As shown in FIGS. 1, and 4 to 10, the exchanger 10 has tube dividing walls within the necks 22, 24, and in portions of the first and second transition portions L, N that are adjacent the respective first and second working fluid ports 14, 16. Each tube dividing wall extends between two or more working fluid flow paths. As is evident from FIGS. 1, 4 and 10, in this embodiment the tube dividing walls include three annular tube dividing walls 44, and twenty four (24) radial tube dividing walls 46. The tube dividing walls 44, 46 form the tube walls of the innermost tube 30, and the tubes 32, 36 of the first and second rings 34, 38. In the case of the tubes of the third ring 42, the walls of the tubes 40 are formed by an outer one of the annular tube dividing walls 44, outer portion of radial tube dividing walls 46, and the outer shell 12.

Figure 11:
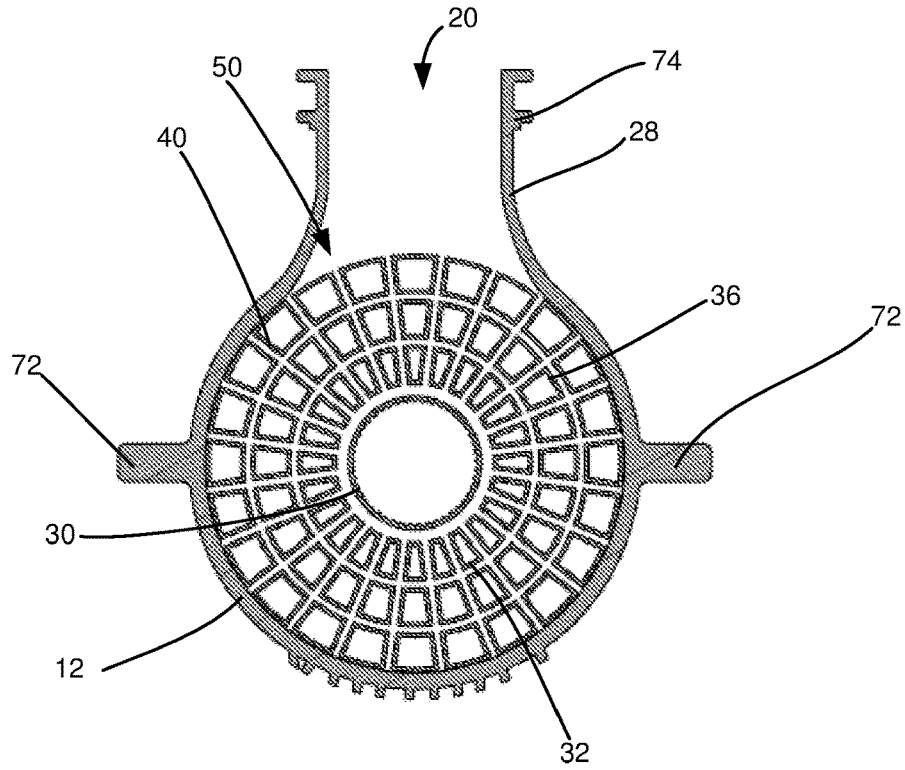
FIG. 11: is a cross section cut of the compact heat exchanger taken along the line E-E in FIG. 3.
Figure 12:
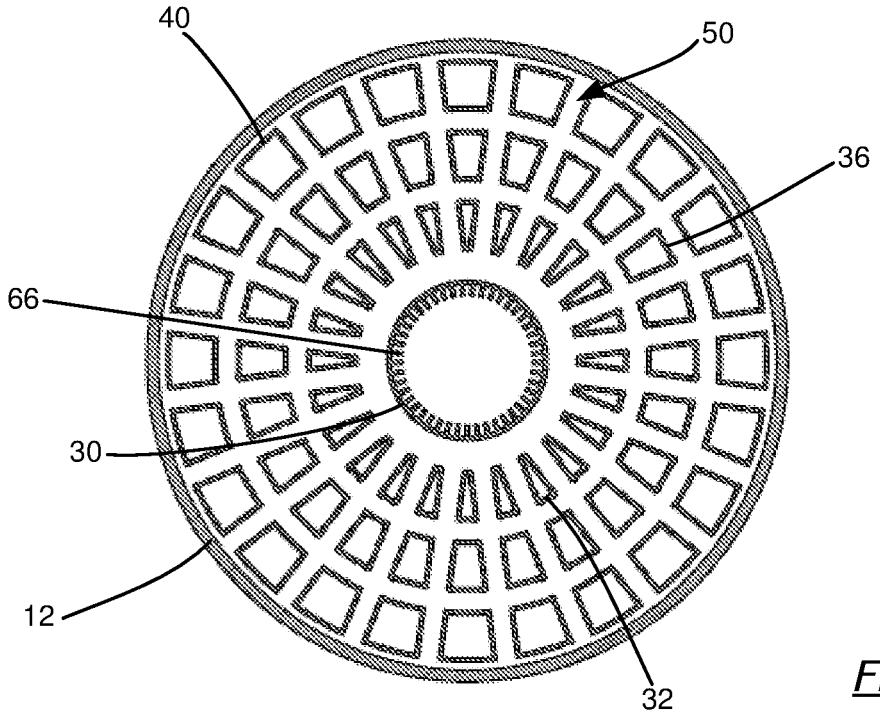
FIG. 12: is a cross section cut of the compact heat exchanger taken along the line F-F in FIG. 3.
Figure 13:
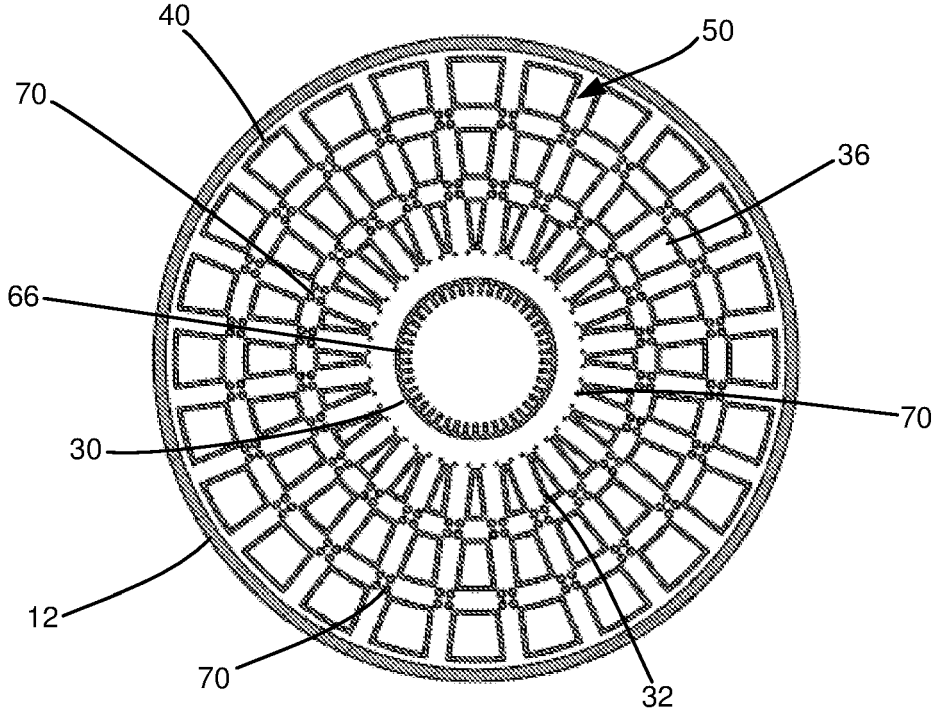
FIG. 13: is a cross section cut of the compact heat exchanger taken along the line G-G in FIG. 3.
Figure 14:
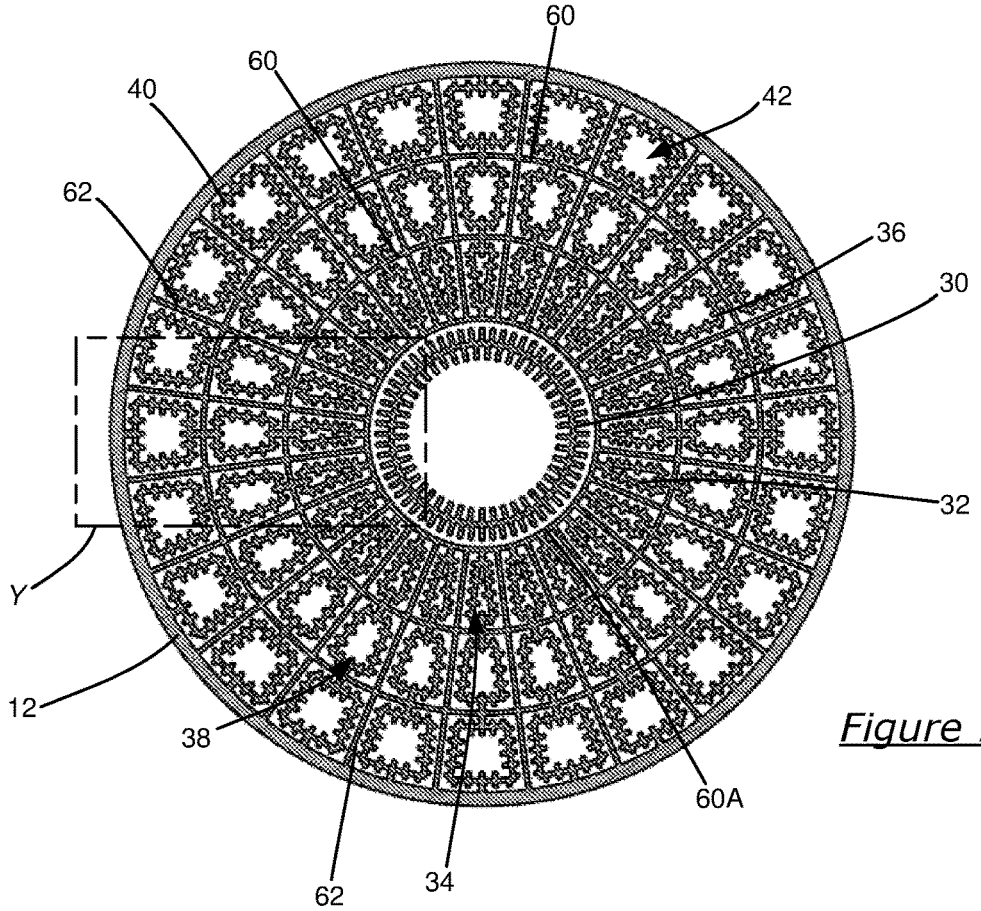
FIG. 14: is a cross section cut of the compact heat exchanger taken along the line H-H in FIG. 3.
Figure 15:
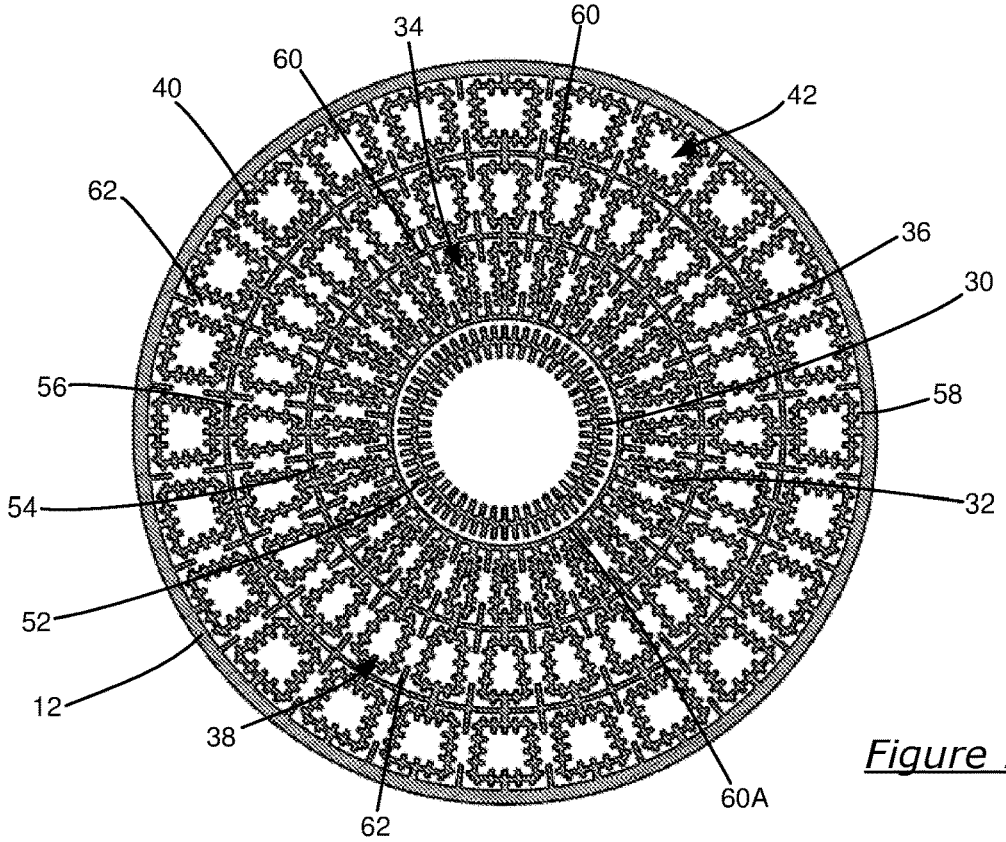
FIG. 15: is a cross section cut of the compact heat exchanger taken along the line J-J in FIG. 3.
Figure 17:
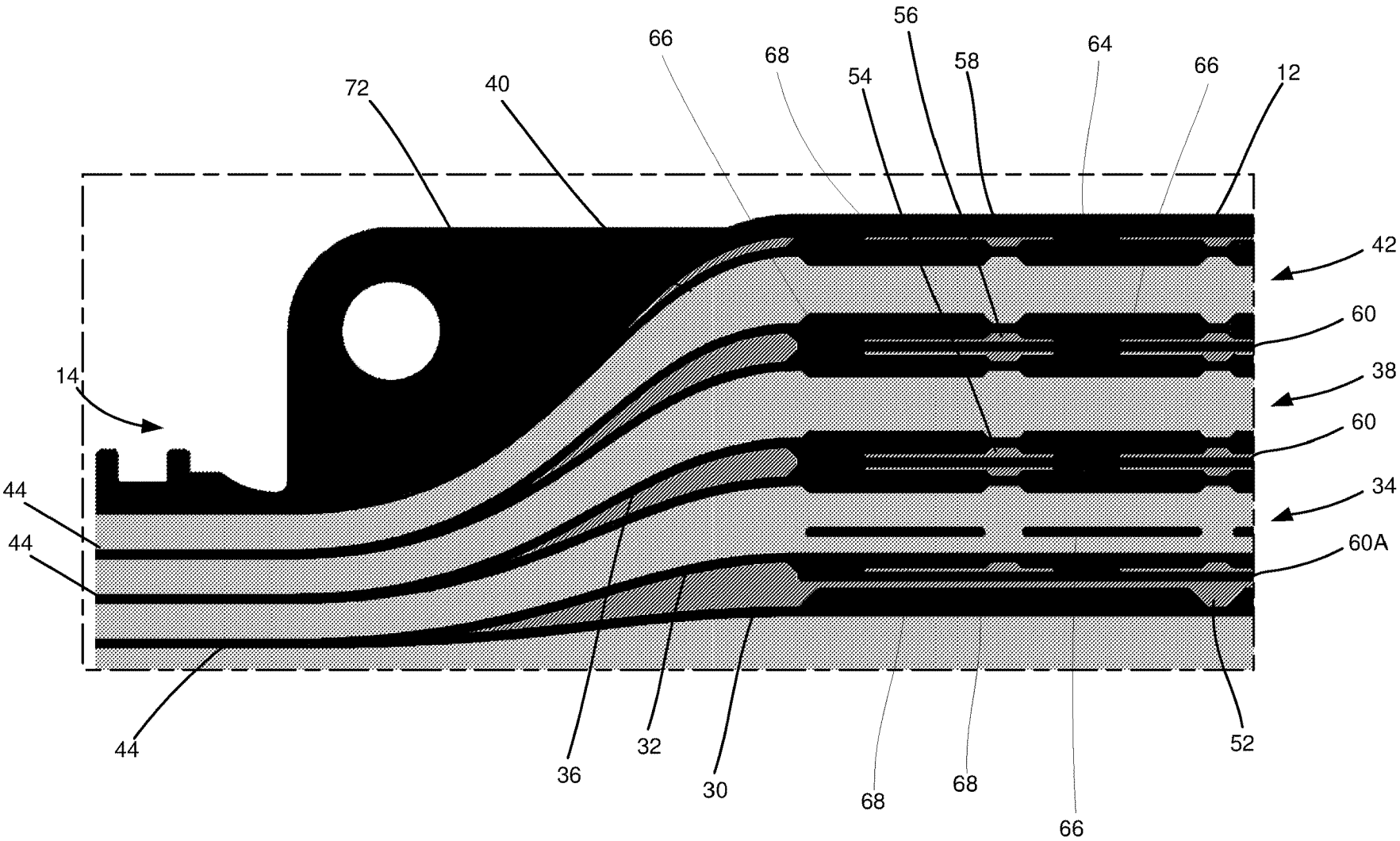
FIG. 17: is an enlarged view of region X in FIG. 8.

As will be particularly evident from FIGS. 11, 12 and 17, when viewed in the direction from the first working fluid port 14 towards the central core region M, each of the tube dividing walls 44, 46 cleaves within the first transition region L to form two separate portions of the walls of multiple tubes. In addition, the outer shell 12 cleaves within the first transition region L to form a part of the wall of the tubes 40 in the third ring 42.

Similarly, when viewed in the direction from the second working fluid port 16 towards the central core region M, each of the tube dividing walls 44, 46 also cleaves within the second transition region N to form two separate portions of the walls of multiple tubes. The outer shell 12 also cleaves within the second transition region N to form a part of the wall of the tubes 40 in the third ring 42. FIG. 2 affords a view through the second coolant port 20, showing an outer one of the annular tube dividing walls 44, which cleaves to form part of the walls of tubes 40 of the third ring 42.

In this particular embodiment, the tube dividing walls 44, 46 terminate flush with the outer shell 12 at each of the first and second working fluid ports 14, 16.

Figure 10:
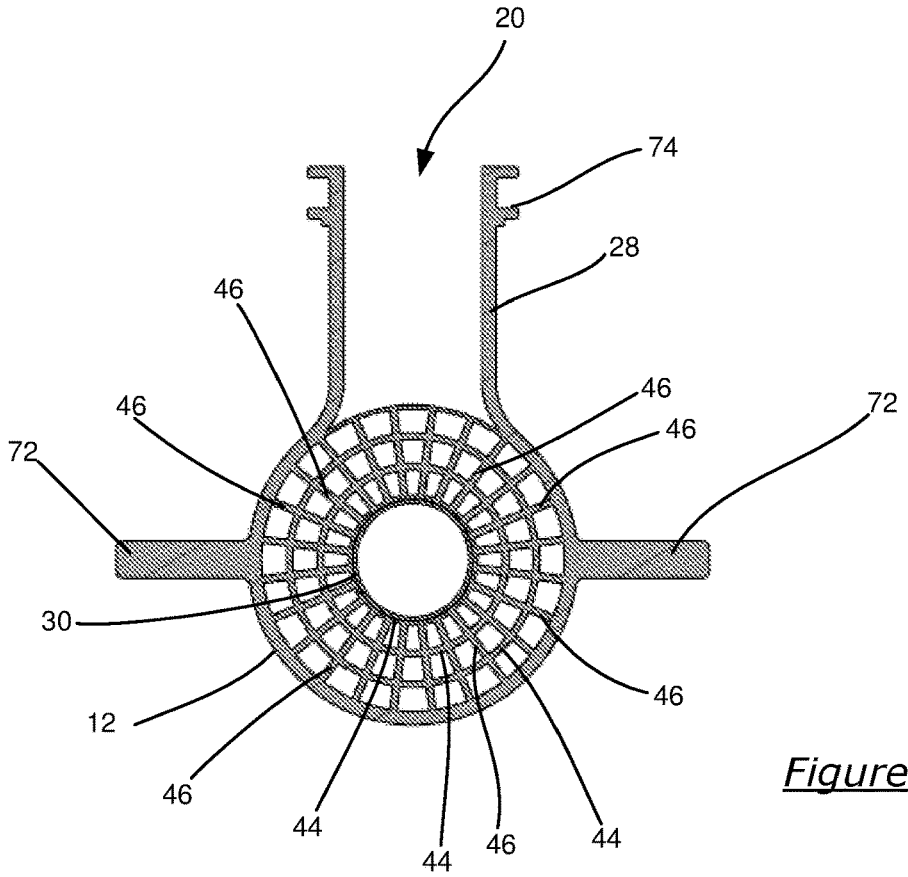
FIG. 10: is a cross section cut of the compact heat exchanger taken along the line D-D in FIG. 3.

By comparing FIG. 10 with FIGS. 11 and 12, it will be evident that the annular tube dividing walls 44 and the radial tube dividing walls 46 part so that within the central core portion M, each of tubes 32, 36, 40 is a discrete element; in other words, within the central core region the tube walls of each working fluid flow path are exclusive to that working fluid flow path.

The cross-sectional area of each tube varies between the first and second working fluid ports 14, 16. In this particular embodiment each tube 30, 32, 36, 40 is greater within the central core region M than the cross-sectional area of the respective tube 30, 32, 36, 40 adjacent the respective first and second working fluid ports 14, 16. In other words, the cross-sectional area of each of the tubes 30, 32, 36, 40 increases from a first cross-sectional area at the first working fluid port 14 through the first transition region L, to a second, larger cross-sectional area within the central core region M. Similarly, the cross-sectional area of each of the tubes 30, 32, 36, 40 decreases from the second cross-sectional area within the central core region M through the second transition region N, to the first cross-sectional area at the second working fluid port 16.

By virtue of the changing cross-sectional area of the tubes 30, 32, 36, 40 in each of the first and second transition regions L, N, the cross-sectional area of the working fluid flow paths collectively increases towards the central core region, and decreases away from the central core region.

Each of the tubes 32, 36, 40 in the first, second and third rings 34, 38, 42 is shaped such that, within the central core region M, the respective tube is radially offset with respect to the innermost tube 30, and relative to the radial position of that tube at each of the first and second working fluid ports 14, 16. Consequently, each working fluid flow path in the first, second and third rings 34, 38, 42 follows a non-linear path (which in this example is an S-curve) through each of the first and second transition portions L, N.

In one configuration, working fluid enters the heat exchanger 10 through the first working fluid port 14, and exits the heat exchanger 10 through the second working fluid port 16. By virtue of the shape of the tubes 32, 36, 40, the working fluid flows outwardly within the first transition region L, and inwardly within the second transition region N. Further, the working fluid flow in each of the first and second transition regions L, N includes a radial component. In other words, the working fluid flow paths diverge and converge in the first and second transition regions.

In the example illustrated in FIGS. 1 to 17, the tubes 30, 32, 36, 40 are shaped such that the working fluid flow paths in the necks 22, 24 and in the central core region M are substantially parallel. Furthermore, the tubes 30, 32, 36, 40 are shaped such that each working fluid flow paths in the necks 22, 24 are also collinear.

Structure of Plenum Space:

The plenum space includes a first coolant manifold 48 that is in communication with the first coolant port 14, and a second coolant manifold 50 that is in communication with the second coolant port 16. In this embodiment, the first coolant manifold 48 is contained within the outer shell 12, and is formed in the first transition region L of the exchanger 10. Similarly, the second coolant manifold 50 is contained within the outer shell 12, and is formed in the second transition region N. As will be evident from FIGS. 5 and 6, the first coolant manifold 48 surrounds the tubes 30, 32, 36, 40 within the first transition region L, and second coolant manifold 50 surrounds the tubes 30, 32, 36, 40 within the second transition region N. FIG. 2 affords a view through the second coolant port 20 and into the second coolant manifold 50.

The plenum space also includes coolant conduits that each surround at least one of the tubes 30, 32, 36, 40, whereby each coolant conduit defines a coolant flow path. The coolant conduits extend through the central core region M of the heat exchanger 10. In this particular embodiment, there are seventy three (73) coolant conduits that each define a coolant flow path surrounding a respective one of the tubes 30, 32, 36, 40. These coolant conduits are arranged into:

- an innermost coolant conduit 52 that surrounds the innermost tube 30;
- an inner set of twenty four (24) coolant conduits 54 that surround tubes 32 and that are arranged in the first ring 34;
- an intermediate set of twenty four (24) coolant conduits 56 that surround tubes 36 and that are arranged in the second ring 38; and
- an outer set of twenty four (24) coolant conduits 58 that surround tubes 40 and that are arranged in the third ring 42.

The heat exchanger 10 has conduit dividing walls that each form a wall for one or more of the coolant conduits 54, 56, 58 in the central core region. The conduit dividing walls include three annular conduit dividing walls 60, and twenty four (24) radial conduit dividing walls 62. The innermost coolant conduit 52 is formed between the innermost tube 30 and the innermost annular conduit dividing wall 60*a*. As will be apparent from FIG. 17, the innermost annular tube dividing wall 44 cleaves in each of the first and second transition regions L, N to form the innermost tube 30 and the innermost annular conduit dividing wall 60*a*, with the innermost coolant conduit 52 being formed therebetween within the central core region M.

The coolant conduits 54 in the first ring 34 are each formed between two of the annular conduit dividing walls 60, and radially adjacent pairs of the radial conduit dividing walls 62; similarly, with regard to the coolant conduits 26 in the second ring 38. The coolant conduits 58 in the third ring 42 are formed by an outer one of the annular conduit dividing walls 60, radially adjacent pairs of the radial conduit dividing walls 62, and the outer shell 12.

In certain embodiments, the annular conduit dividing walls 60 have a circular cross section, and are concentric with each other and the outer shell 12. Thus, each of the coolant conduits 54, 56, 58 in the first, second and third rings 34, 38, 42 have the cross section of an annular segment. Further, each of the tubes 32, 36, 40 in the first, second and third rings 34, 38, 42 also have the cross section of an annular segment.

The heat exchanger 10 includes bridging members 64 in the first, second, and third rings 34, 38, 42 that each space the walls of the tubes 32, 36, 40 within the respective coolant conduits 54, 56, 58. In the first and second rings 34, 38, the bridging members 64 each extend between one of the annular conduit dividing walls 60 and one of the tube walls 62, 36. In the third ring 42, bridging members 64 extend between outer one of the annular conduit dividing walls 60 and the wall of tubes 40, and also between the wall of tubes 40 and the outer shell 12. The bridging member 64 are provided within the central core region M. Further, each bridging member 54 extends radially with respect to the heat exchanger 10, and parallel with respect to the coolant flow path.

Heat Transfer Fins:

Each of the tubes 30, 32, 36, 40 has a central portion with fins (hereinafter referred to as "heat absorbing fins 66") that each project from one of the tube walls 30, 32, 36, 40 into the respective working fluid flow path. In addition, each of the tubes 30, 32, 36, 40 has two end portions in which the surfaces of the tube walls that face the working fluid flow paths are smooth. In an application in which the heat exchanger 10 is used to transfer thermal energy from the working fluid to the coolant, the heat absorbing fins 66 increase the surface area in contact with the working fluid, which enhances heat absorption into the walls of the tubes 30, 32, 36, 40.

Each of the tubes 30, 32, 36, 40 also include a central portion having fins (hereinafter referred to as "heat discharge fins 68") that each project from one of the tube walls 30, 32, 36, 40 into the respective coolant flow path. In addition, each of the tubes 30, 32, 36, 40 has two end portions in which the surfaces of the tube walls that face the coolant flow paths are smooth. Again, in an application in which the heat exchanger 10 is used to transfer thermal energy from the working fluid to the coolant, the heat discharge fins 68 increase the surface area in contact with the coolant, which enhances heat transfer from the walls of the tubes 30, 32, 36, 40 and into the coolant.

The fins 66, 68 projecting from tubes 32, 36, 40 are provided within the central core region M of the heat exchanger 10, as will be evident from FIGS. 5 to 9. Similarly, with regard to the heat discharge fins 68 that project from the innermost tube 30 into the innermost coolant conduit 52. These heat discharge fins 68 projecting radially outwardly from the innermost tube 30 into the innermost coolant conduit 52.

Figure 5:
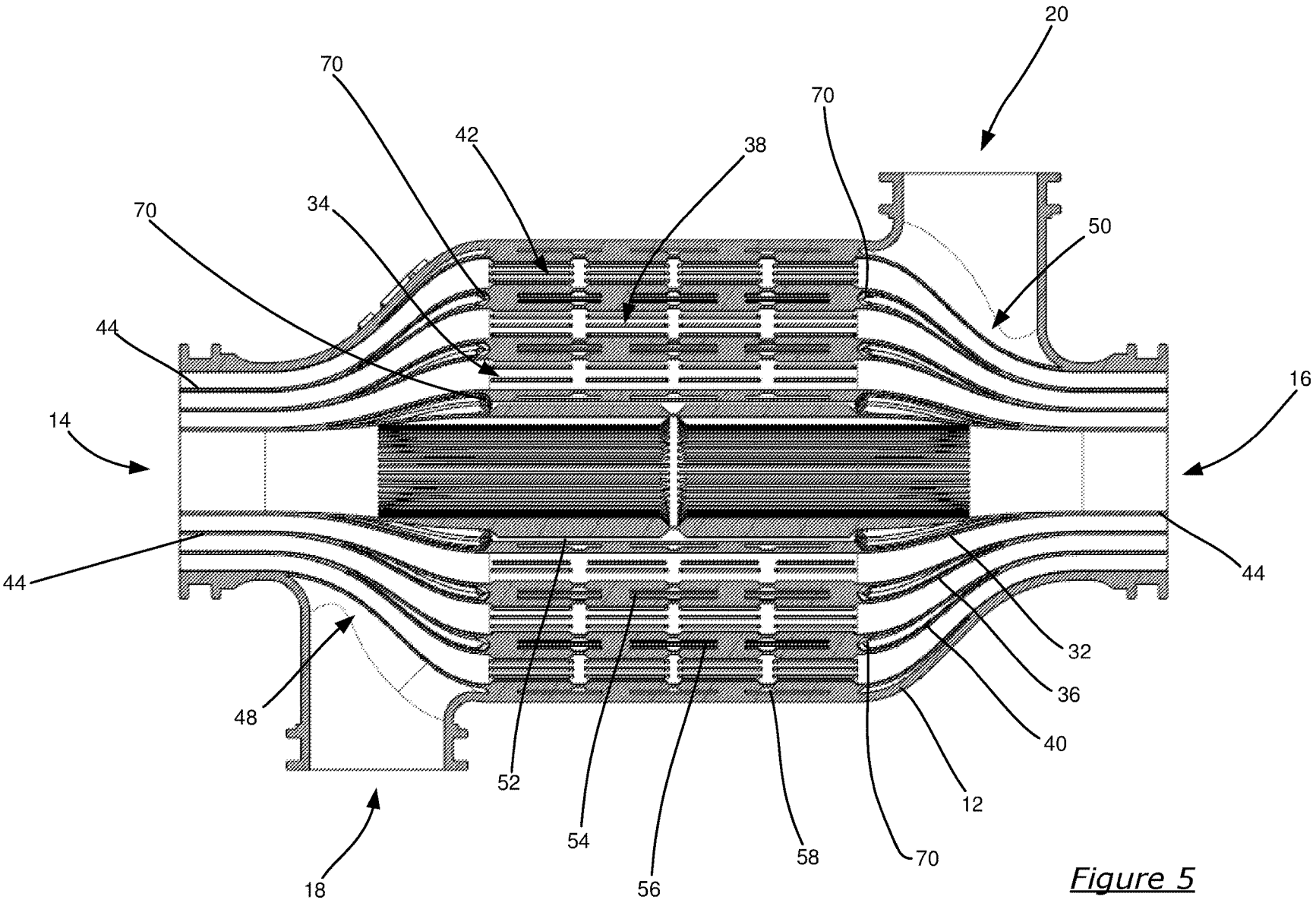
FIG. 5: is a cross section view of the compact heat exchanger as viewed along the line A-A in FIG. 4.
Figure 6:
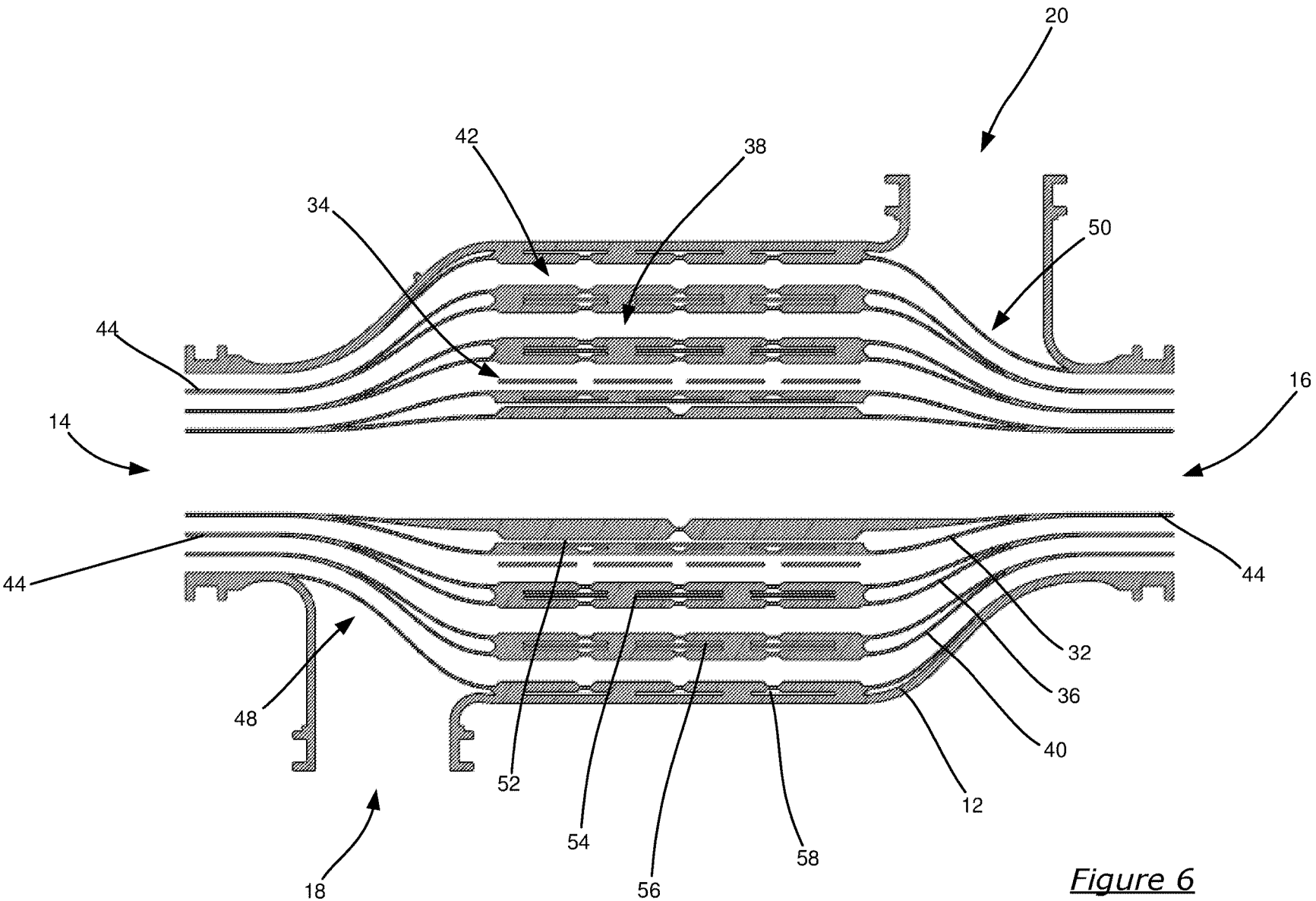
FIG. 6: is a cross section cut of the compact heat exchanger taken along the line A-A in FIG. 4.
Figure 7:
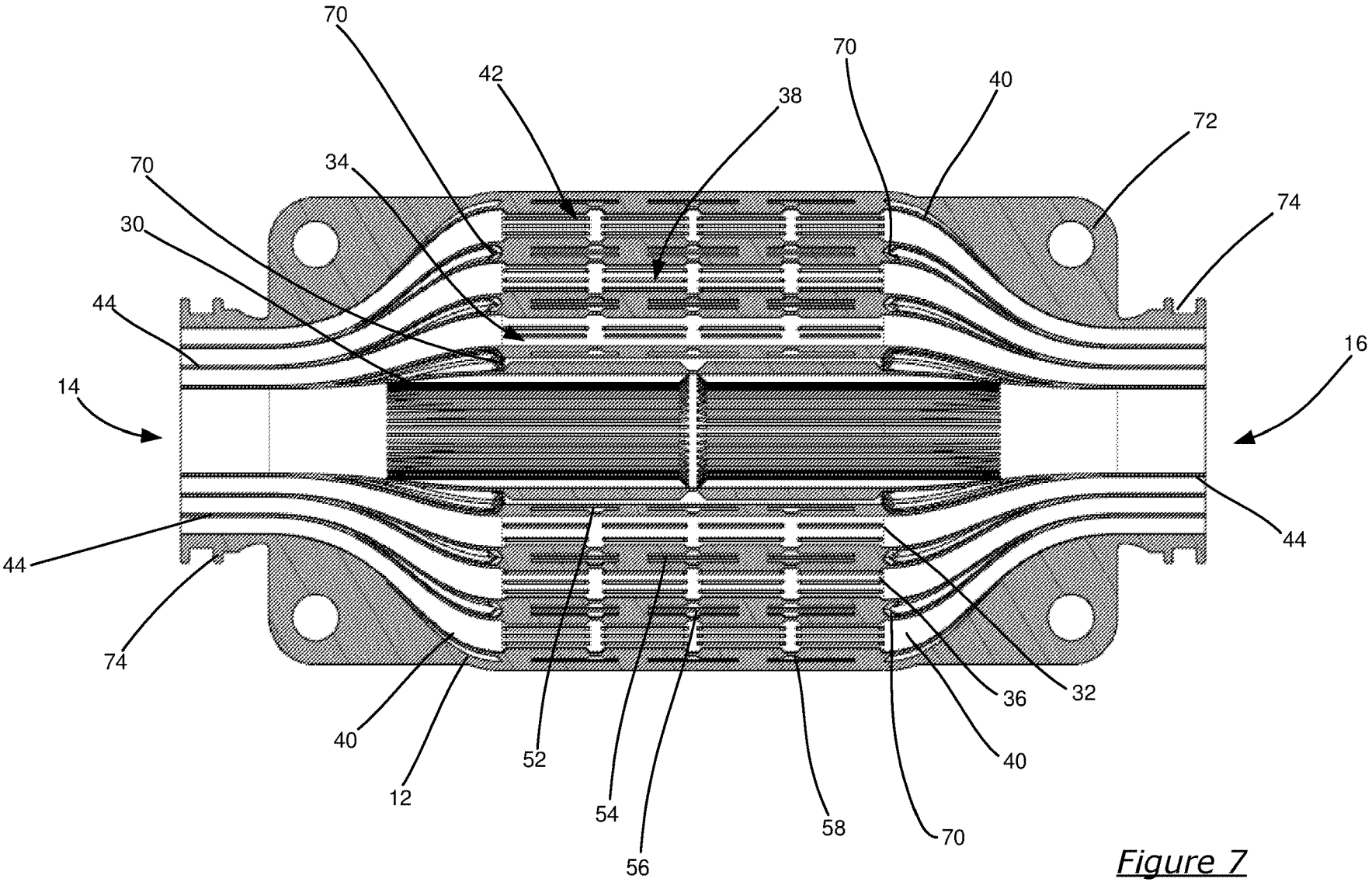
FIG. 7: is a cross section view of the compact heat exchanger as viewed along the line B-B in FIG. 4.
Figure 8:
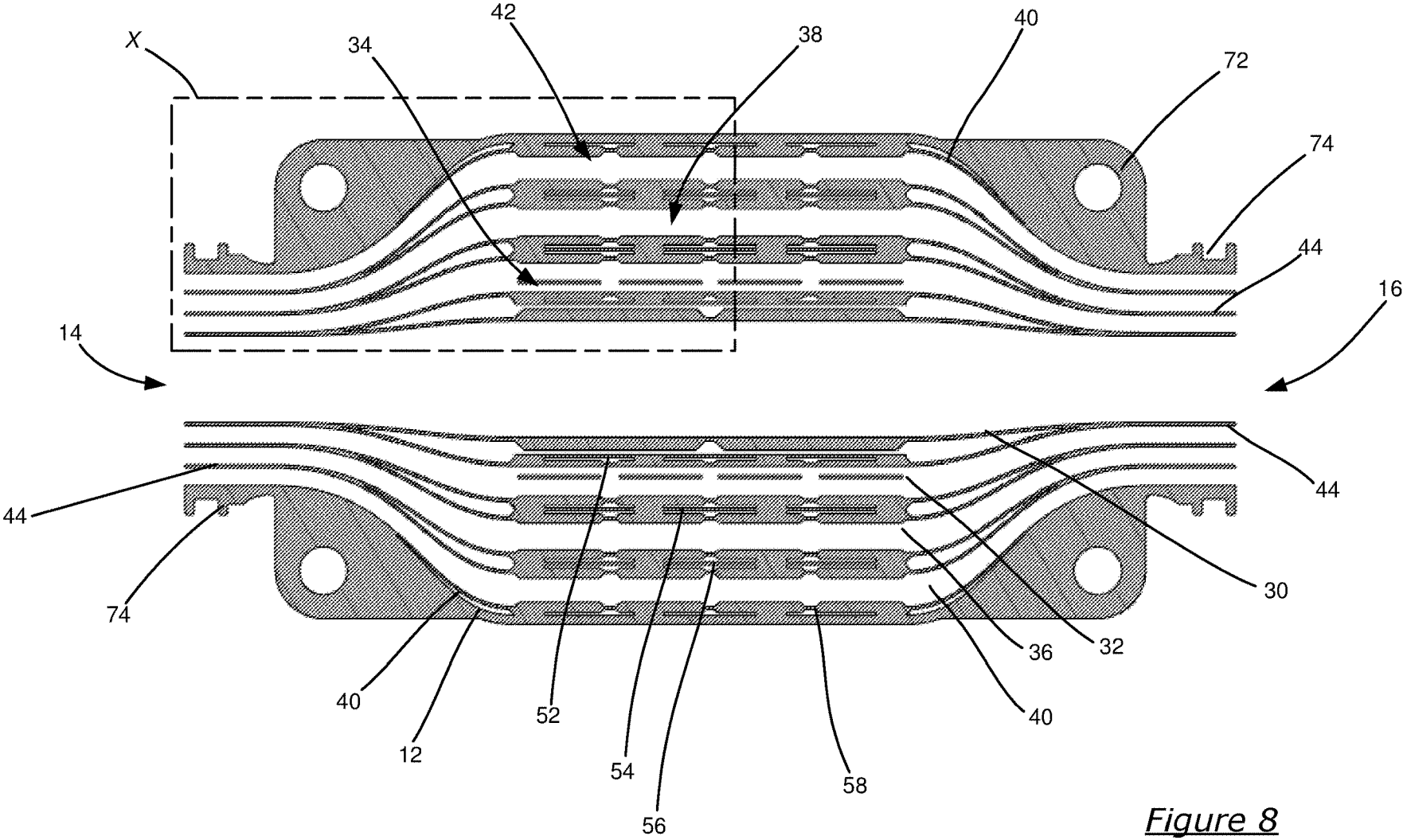
FIG. 8: is a cross section cut of the compact heat exchanger taken along the line B-B in FIG. 4.
Figure 9:
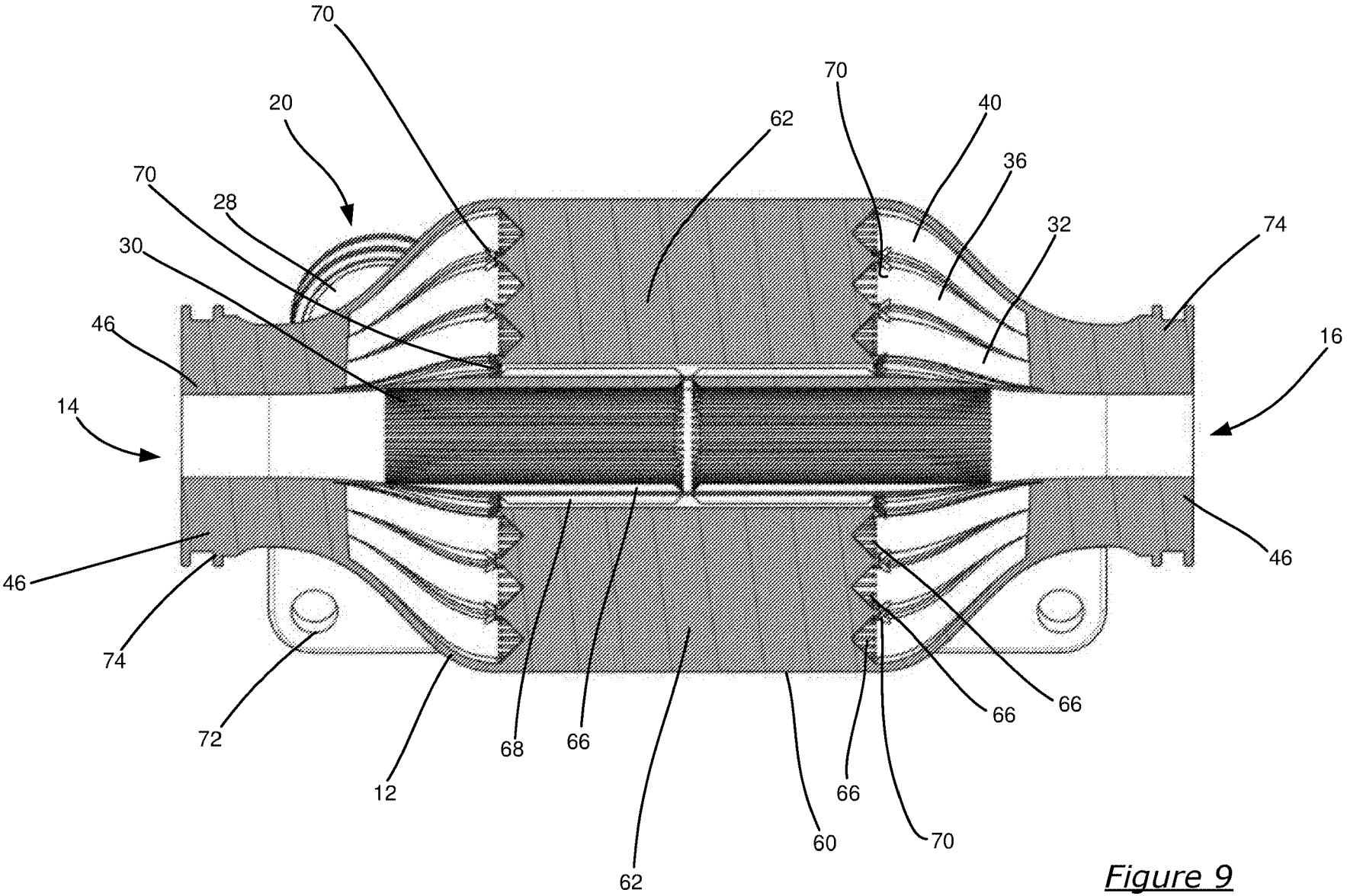
FIG. 9: is a cross section view of the compact heat exchanger as viewed along the line C-C in FIG. 4.

The heat absorbing fins 66 that project from the innermost tube 30 into the innermost working fluid flow path have axial end that terminate in one of the first and second transition regions L, N, as will be most evident from FIGS. 5 and 6. In addition, these heat absorbing fins 68 project radially inwardly from the innermost tube 30 into the innermost working fluid flow path.

In this embodiment, the heat absorbing fins 66 all extend parallel to the respective working fluid flow path. Similarly, the heat discharge fins 68 all extend parallel to the respective conduit flow path. The fins 66, 68 are arranged in sets of two or more fins that are spaced apart in the direction of the respective working fluid flow path or coolant flow path, and within each set the fins 66, 68 are parallel with one another. In the case of heat absorbing fins 68 that project radially inwardly from the innermost tube 30 into the innermost working fluid flow path, and the heat discharge fins 68 that project radially outwardly from the innermost tube 30 into the innermost coolant conduit 52, the fins 66, 68 are arranged in sets of spaced apart two fins. The fins 66, 68 projecting from walls of the tubes 32, 36, 40 are arranged in sets of spaced apart four fins.

The longitudinal separation of the fins 66, 68 described above minimizes the development of boundary layers in the respective fluid flow. Consequently, the fluid flow within the respective flow path has increased turbidity, which encourages mixing of the fluid and enhances transfer of thermal energy to/from the heat exchanger structures.

The end portions of the tubes 30, 32, 36, 40 have wall surfaces are that are devoid of features and/or are "plain". In other words in these end portions, the cross sections of the tubes 30, 32, 36, 40 are shaped such that the internal surfaces of the tube walls are inwardly concave, and the external surfaces of the tube walls are outwardly convex. It will be apparent from the Figures that the internal surfaces of the tube walls face the working fluid flow paths, and the external surfaces face the coolant flow paths. In this way, the surfaces of the tube walls in the end portions can be considered to be "smooth". However, it will be appreciated that some manufacturing techniques will leave surface finish that would be considered rough, and in this regard the surface finish is a distinct property to the surface shape. In this embodiment, the end portions are coincident with decreasing cross-sectional areas of the working fluid flow paths and coolant flow paths respectively. Accordingly, in regions of lesser cross-sectional area, the smooth wall surfaces of the tubes ensure that resistance to fluid flow is minimal.

Figure 16:
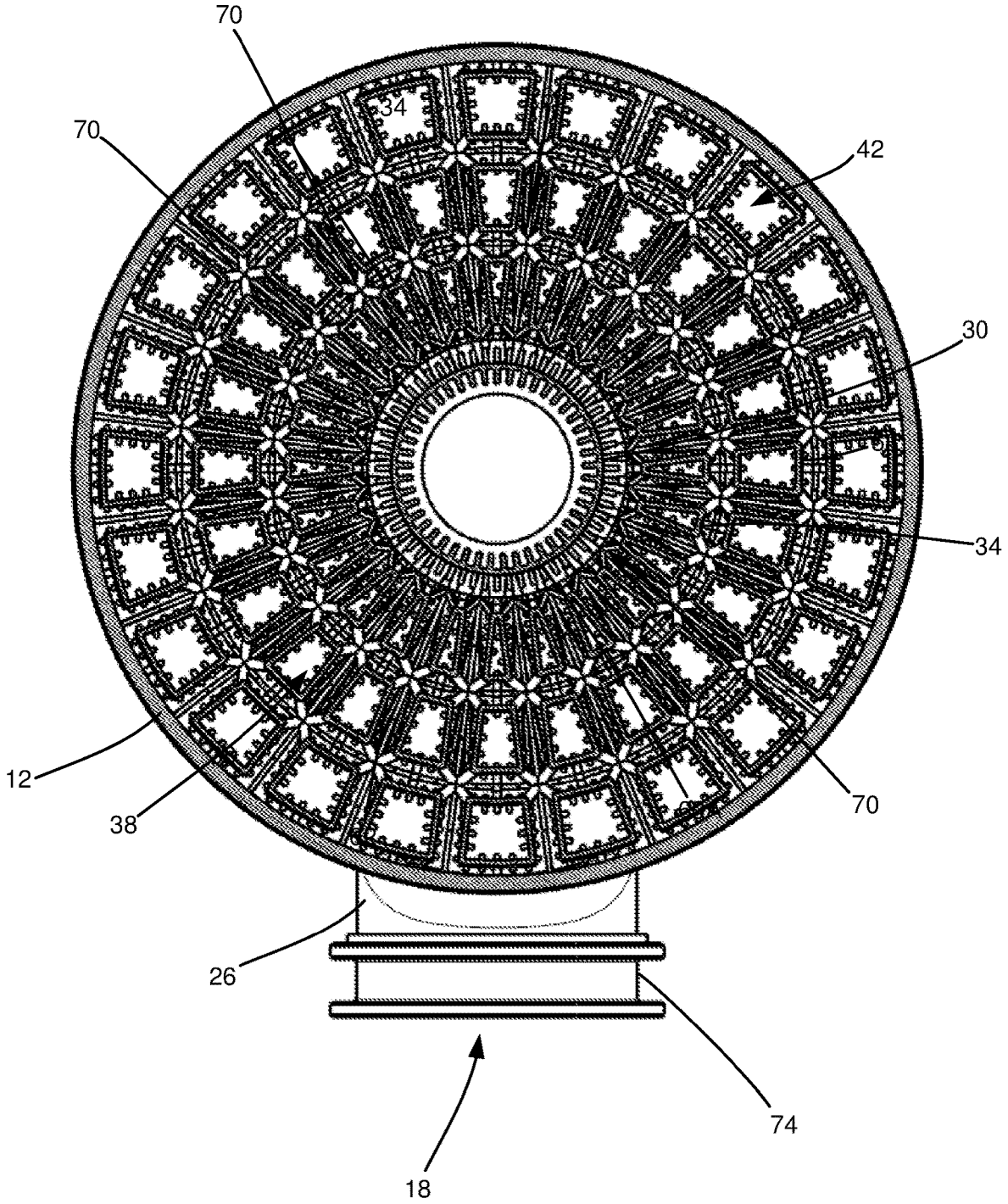
FIG. 16: is a cross section view of the compact heat exchanger as viewed along the line J-J in FIG. 3.

Buttress Supports:

As shown most clearly in FIG. 16, the heat exchanger 10 includes buttress supports 70 that each connect one of the tube walls 32, 36, 40 to an end of at least one of the conduit dividing walls 60, 62. In embodiments in which the heat exchanger 10 is formed using additive manufacturing techniques, the buttress supports 70 facilitate formation of the conduit dividing walls 60, 62 in a geometrically accurate position relative to the partially formed tubes 32, 36, 40.

In this particular embodiment, the annular conduit dividing walls 60 and radial conduit dividing walls 62 form intersections at locations that are intermediate of groups of four tubes 32, 36, 40. The buttress supports 70 each connect to the annular conduit dividing walls 60 and radial conduit dividing walls 62 at these intersections.

Buttress supports 70 on the radially inner periphery of the first ring 34 extend from adjacent pairs of the tubes 32 and connect to the intersection between the innermost annular conduit dividing wall 60*a* and one of radial conduit dividing walls 62. At the intersections of the annular conduit dividing walls 60 and one of radial conduit dividing walls 62 that are between the first and second rings 38, 40, buttress supports 70 extend from groups of four tubes 32, 36, 40 that surround each intersection.

In this particular embodiment, the heat exchanger 10 is formed by an additive manufacturing technique. Accordingly, the heat exchanger 10 is a jointless and seamless unitary component. In other words, the heat exchanger 10 components are continuous and non-interrupted.

In this particular embodiment, the heat exchanger 10 has four mounting flanges 72 that each have a through hole to enable mounting of the exchanger on a structure with the use of appropriate fasteners.

The heat exchanger 10 includes a connecting member 74 at each of the first working fluid port 14, the second working fluid port 16, the first coolant port 18, and the second coolant port 20. Each connecting member 74 is to mate with a tube piece to connect the heat exchanger 10 into a cooling system. In this embodiment, each connecting member 74 is in the form of a pair of spaced apart annular rings between which an O-ring (not shown) can be positioned. In alternative embodiments, other forms of connecting members may be provided to suit the cooling system in which the heat exchanger is to operate.

FIGS. 19 to 38 show a heat exchanger 110 in accordance with a second embodiment of the present invention. In use, the heat exchanger 110 is to transfer thermal energy between a first working fluid and a second working fluid. Again, for simplicity in the description that follows, the first working fluid is referred to simply as "working fluid", and the second working fluid is referred to as "coolant". Physical embodiments made in accordance with embodiment as illustrated in FIGS. 19 to 38 can provide a compact heat exchanger.

The heat exchanger 110 is substantially similar to the heat exchanger 10 of FIG. 1. In FIGS. 19 to 38, the features of the heat exchanger 110 that are substantially similar to those of the heat exchanger 10 have the same reference numeral with the prefix "1".

The heat exchanger 110 has an outer shell 112 that has a plurality of openings that include a first working fluid port 114, a second working fluid port 116, a first coolant port 118, and a second coolant port 120.

A set of tubes extend within the outer shell 112 and between the first and second working fluid ports 114, 116, such that working fluid can flow in parallel through the tubes. The structure of the tubes of the heat exchanger 110 in this embodiment will be discussed in further detail below.

A plenum space, through which coolant is to flow, extends within the outer shell 112 and between the first and second coolant ports 118, 120. The plenum space surrounds the tubes such that thermal energy can be transferred between the two working fluids. The plenum space, and its structure will be discussed in further detail below.

Figure 21:
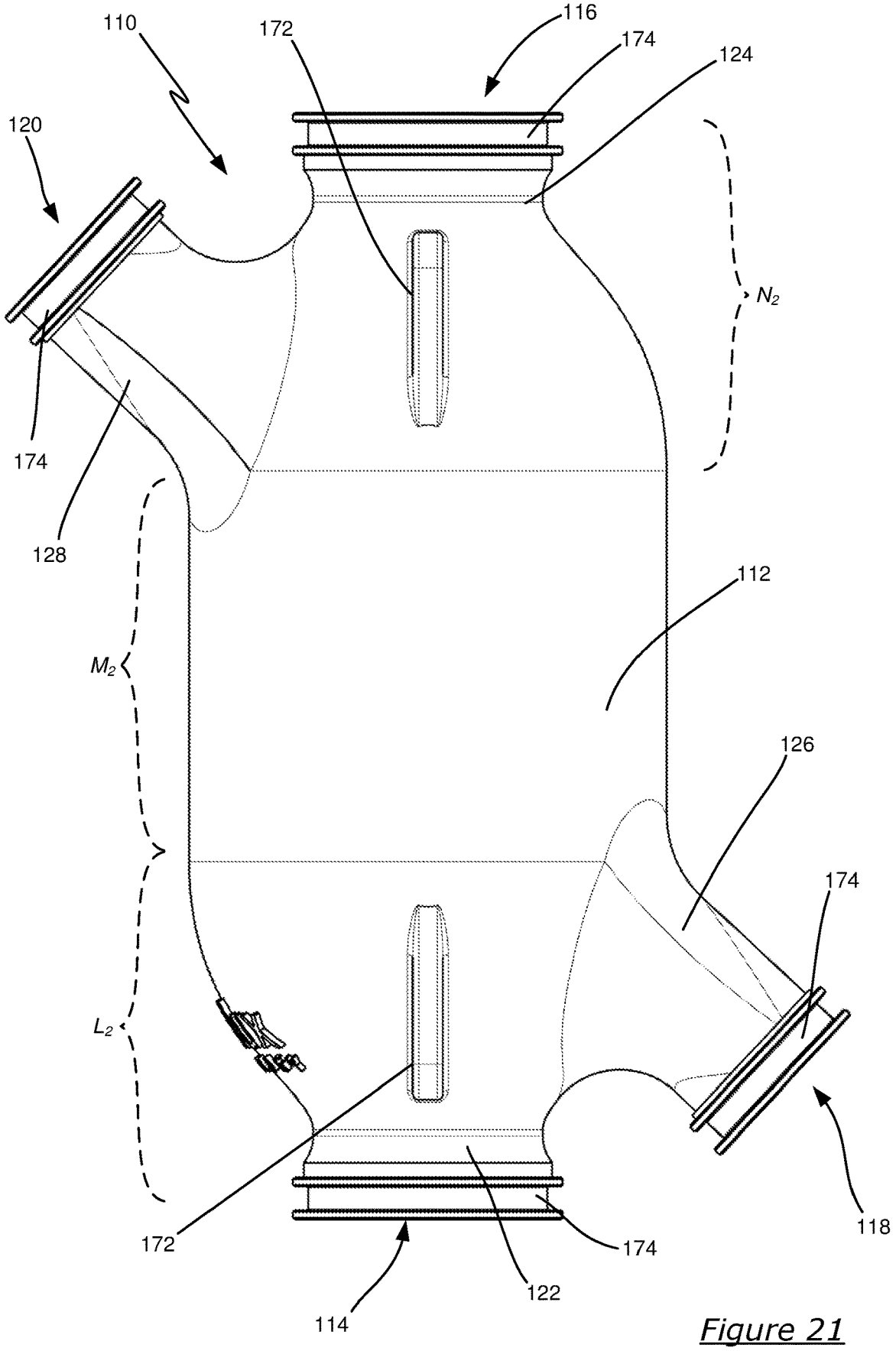
FIG. 21: is a side view of the heat exchanger of FIG. 19.
Figure 22:
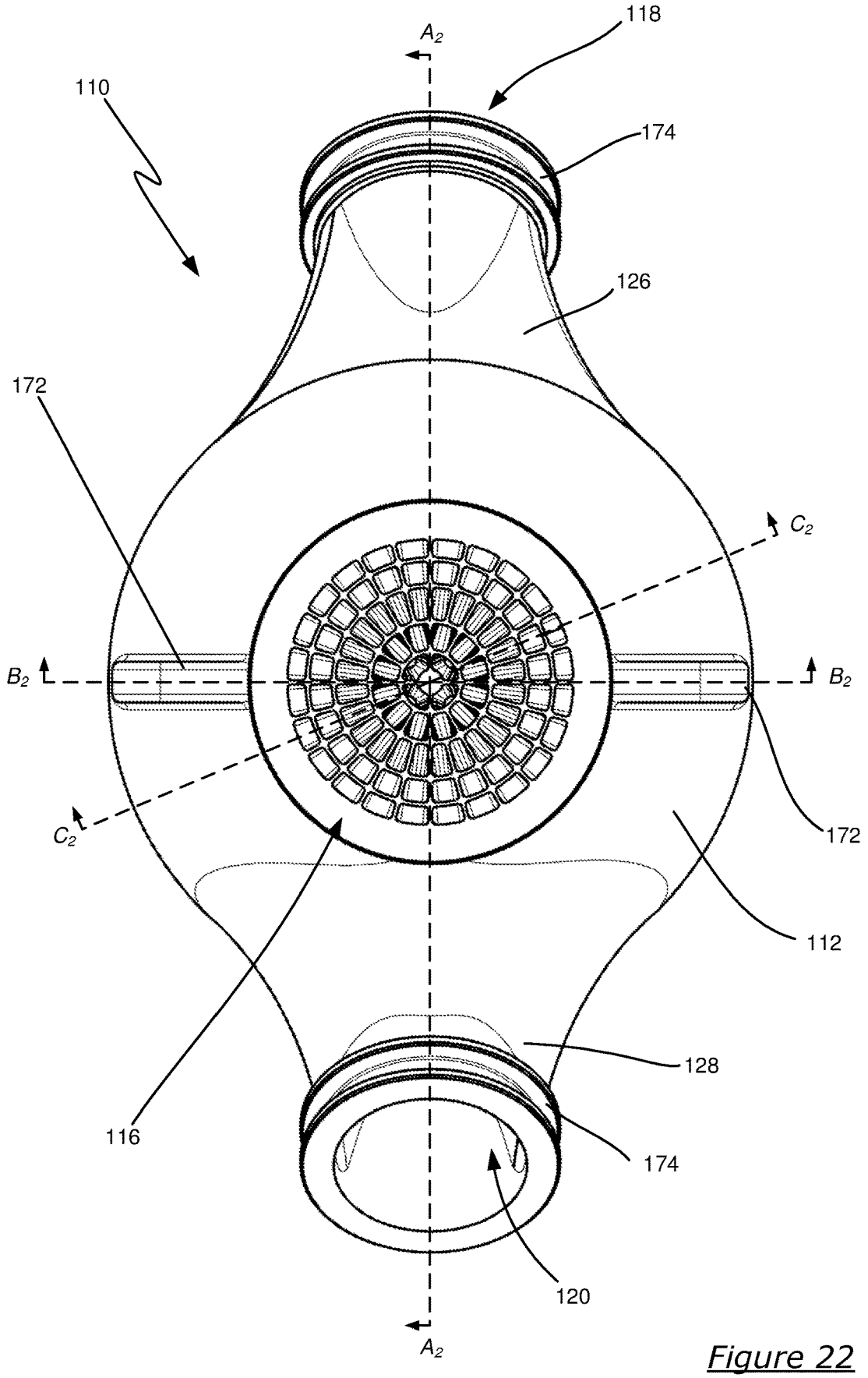
FIG. 22: is an end view of the heat exchanger of FIG. 19.

As shown in FIG. 21, in this embodiment the heat exchanger 110 has a central core region (indicated by curly brackets "$M_2$" in FIG. 21), a first transition region (indicated by curly brackets "$L_2$" in FIG. 21) that extends between the first working fluid port 114 and the central core region $M_2$, and a second transition region (indicated by curly brackets "$N_2$" in FIG. 21) that extends between the second working fluid port 116 and the central core region $M_2$.

In this embodiment, the first working fluid port 114 includes a neck portion 122 of the outer shell 112, and the second working fluid port 116 includes a neck portion 124 of the outer shell 112. In each of the first and second transition regions $L_2$, $N_2$, the diameter of the shell increases from the respective neck 122, 124 towards the central core region $M_2$. The central core region $M_2$ is substantially cylindrical.

Further, the outer shell 112 includes a stem 126 within the first transition region $L_2$, the stem 126 directs coolant received (or discharged) from the first coolant port 118 into the exchanger 110. Similarly, the outer shell 112 includes a stem 128 within the second transition region $N_2$, the stem 128 directs coolant discharged (or received) from the second coolant port 120 out of the exchanger 110.

As is evident from FIG. 21, in this embodiment, the outer shell 112 is arranged such that stems 126, 128 are disposed at an acute angle to the general direction of working fluid flow through the heat exchanger 110 and between the first and second working fluid ports 114, 116.

Structure of Tubes:

In this particular embodiment, there are eighty five (85) tubes that each define a working fluid flow path through the heat exchanger 110. These tubes are arranged into five sets of concentric rings, as follows:

- a first set of four (4) tubes 132*a* that are arranged centrally within the heat exchanger 110 to form a first ring 130*a;*
- a second set of twelve (12) tubes 132*b* that are arranged in a second ring 130*b* around the first ring 130*a;*
- a third set of twenty four (24) tubes 132*c* that are arranged in a third ring 130*c* around the second ring 130*b;*
- a fourth set of twenty four (24) tubes 132*d* that are arranged in a fourth ring 130*d* around the first ring 130*c*; and
- a fifth set of twenty four (24) tubes 132*e* that are arranged in a fifth ring 130*e* around the second ring 130*d*.

Hereinafter where the context is not specific to a particular tube or set of tubes the tubes 132*a*, 132*b*, 132*c*, 132*d*, 132*e* are referred to individually as "tube 132", and collectively as "tubes 132".

As shown in FIGS. 19, and 22 to 27, the exchanger 110 has tube dividing walls within the necks 122, 124, and in portions of the first and second transition portions $L_2$, $N_2$ that are adjacent the respective first and second working fluid ports 114, 116. Each tube dividing wall extends between two or more working fluid flow paths. As is evident from FIGS. 22 and 27, in this embodiment the tube dividing walls include radial walls 144 that are oriented radially with respect to the respective working fluid port, and arcuate walls 146 that are oriented concentrically with respect to the respective working fluid port. The radial walls 144 circumferentially separate the adjacent tubes within a respective one of the five rings. The arcuate walls 146 radially separate the tubes in adjacent pairs of the five rings. In this particular embodiment, each of the arcuate walls 146 has the shape of a cylindrical segment; in other words, the cross section of each arcuate wall 146 is a circular segment.

In the case of the tubes 132*e* of the fifth ring 130*e*, the walls defining each tube 132*e* are formed by one of the arcuate walls 146, two radial walls 146, and the outer shell 112.

As will be particularly evident from FIGS. 23 to 26 and 37, when viewed in the direction from the first working fluid port 114 towards the central core region $M_2$, each of the tube dividing walls 144, 146 cleaves within the first transition region $L_2$ to form two separate portions of the walls of multiple tubes. Similarly, when viewed in the direction from the second working fluid port 116 towards the central core region $M_2$, each of the tube dividing walls 144, 146 also cleaves within the second transition region $N_2$ to form two separate portions of the walls of multiple tubes.

The cross-sectional area of each tube varies between the first and second working fluid ports 114, 116. In this example, the cross-sectional area of each tube 132*e*, 130*b*, 130*c*, 130*d*, 130*e* is greater within the central core region $M_2$ than the cross-sectional area of the respective tube 132 adjacent the respective first and second working fluid ports 114, 116. In other words, the cross-sectional area of each of the tubes 132 increases from a first cross-sectional area at the first working fluid port 114 through the first transition region $L_2$, to a second, larger cross-sectional area within the central core region $M_2$. Similarly, the cross-sectional area of each of the tubes 132 decreases from the second cross-sectional area within the central core region $M_2$ through the second transition region $N_2$, to the first cross-sectional area at the second working fluid port 116. Further, each working fluid flow path through the heat exchanger 110 follows a non-linear path.

In the example illustrated in FIGS. 18 to 37, the tubes 132 are shaped such that the working fluid flow paths in the necks 122, 124 and in the central core region $M_2$ are substantially parallel. Furthermore, the tubes 132 are shaped such that each working fluid flow paths in the necks 122, 124 are also collinear.

Structure of Plenum Space:

The plenum space includes a first coolant manifold 148 that is in communication with the first coolant port 114, and a second coolant manifold 150 that is in communication with the second coolant port 116. In this embodiment, the first coolant manifold 148 is contained within the outer shell 112, and is formed in the first transition region $L_2$ of the exchanger 110. Similarly, the second coolant manifold 150 is contained within the outer shell 112, and is formed in the second transition region $N_2$. As will be evident from FIG. 23, the first coolant manifold 148 surrounds the tubes 132 within the first transition region $L_2$, and second coolant manifold 150 surrounds the tubes 132 within the second transition region $N_2$.

The plenum space also includes coolant conduits that are each separated by the tubes 132 from one or more of the working fluid flow paths. Each coolant conduit defines a coolant flow path. The coolant conduits extend through the central core region $M_2$ of the heat exchanger 110.

The heat exchanger 110 has one hundred and seventy-six (176) discrete coolant conduits that each define a coolant flow path that is adjacent one or more working fluid flow paths. In this particular embodiment, the heat exchanger 110 has, within the central core region $M_2$, bridging elements 160 that extend longitudinally within the heat exchanger 110. Each bridging element 160 is joined to walls of the tubes 132 and separates adjacent coolant conduits. Further, the bridging elements 160 provide geometric stability to the tube dividing walls within the central core region $M_2$.

Figure 18:
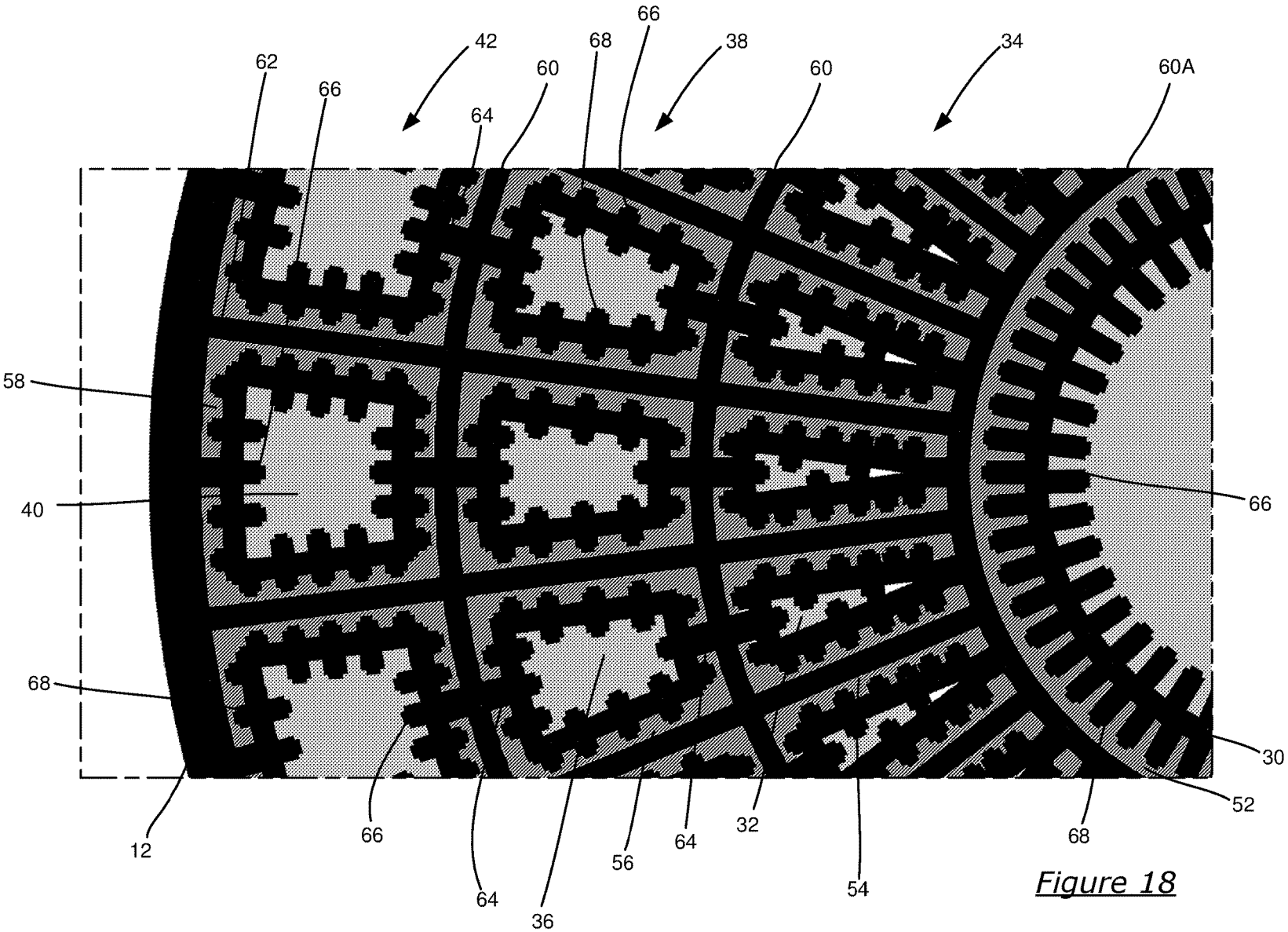
FIG. 18: is an enlarged view of region Y in FIG. 14.
Figure 19:
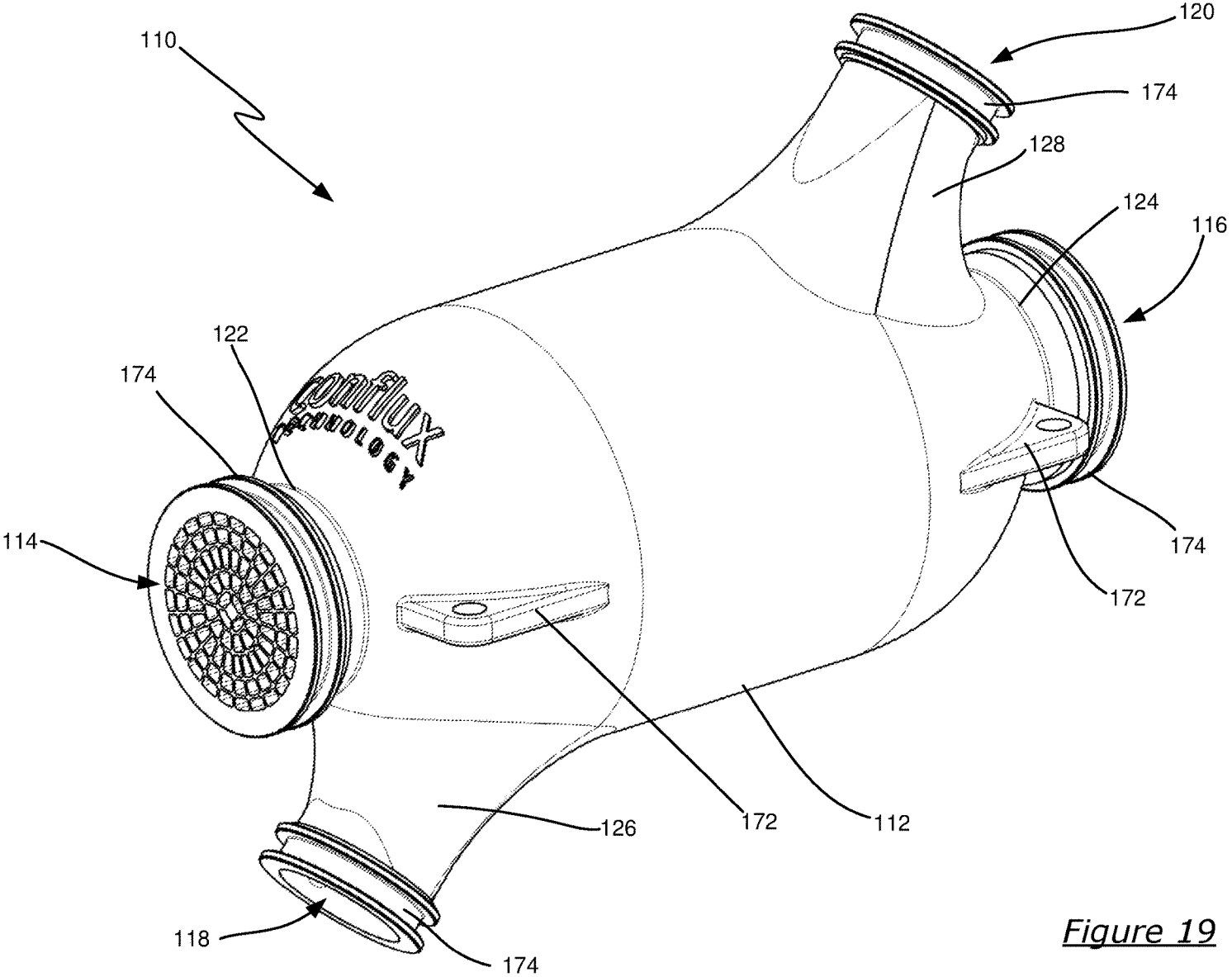
FIG. 19: is a perspective view of a heat exchanger in accordance with a second embodiment of the present invention.
Figure 20:
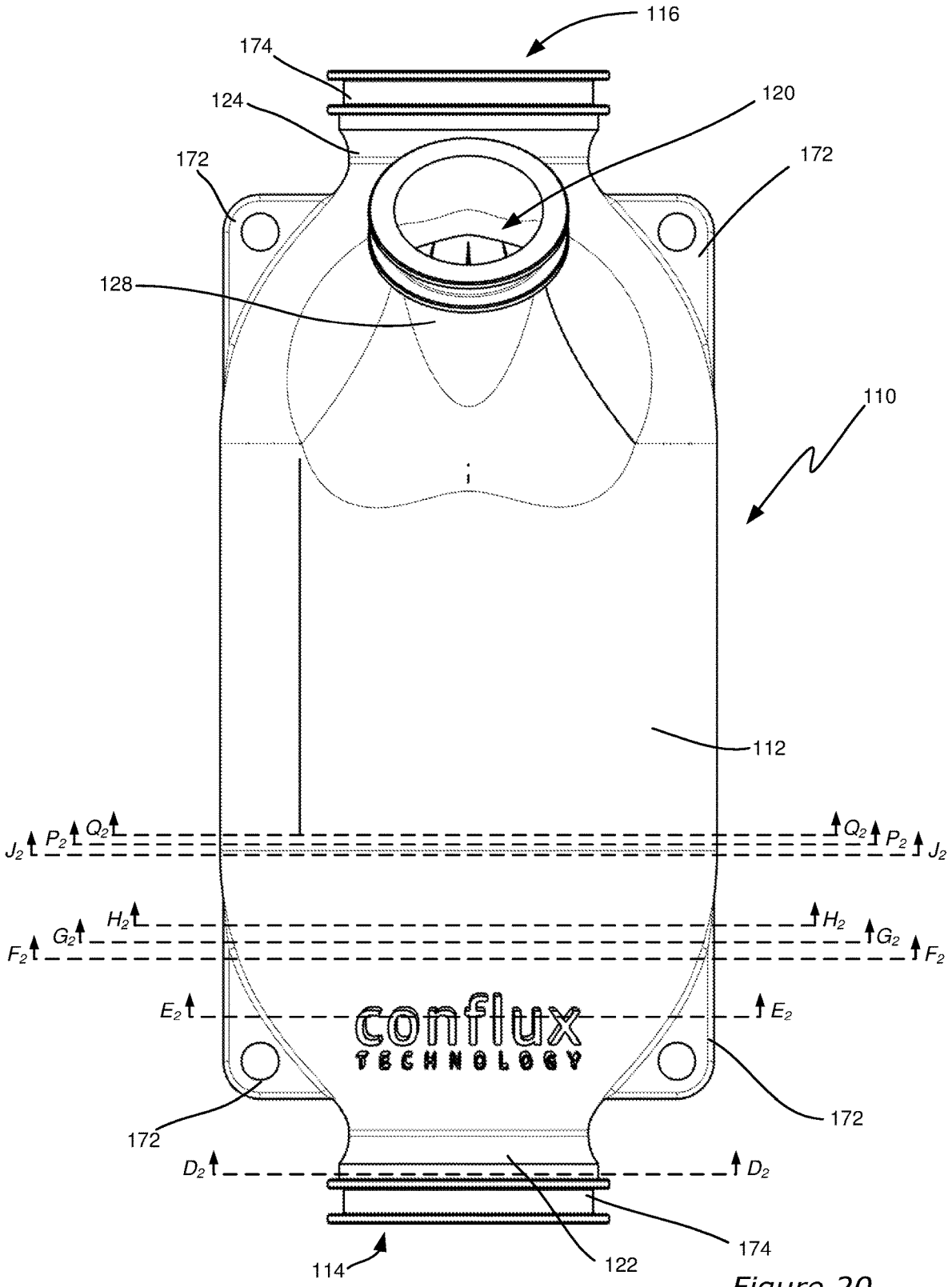
FIG. 20: is a top view of the heat exchanger of FIG. 19.
Figure 38:
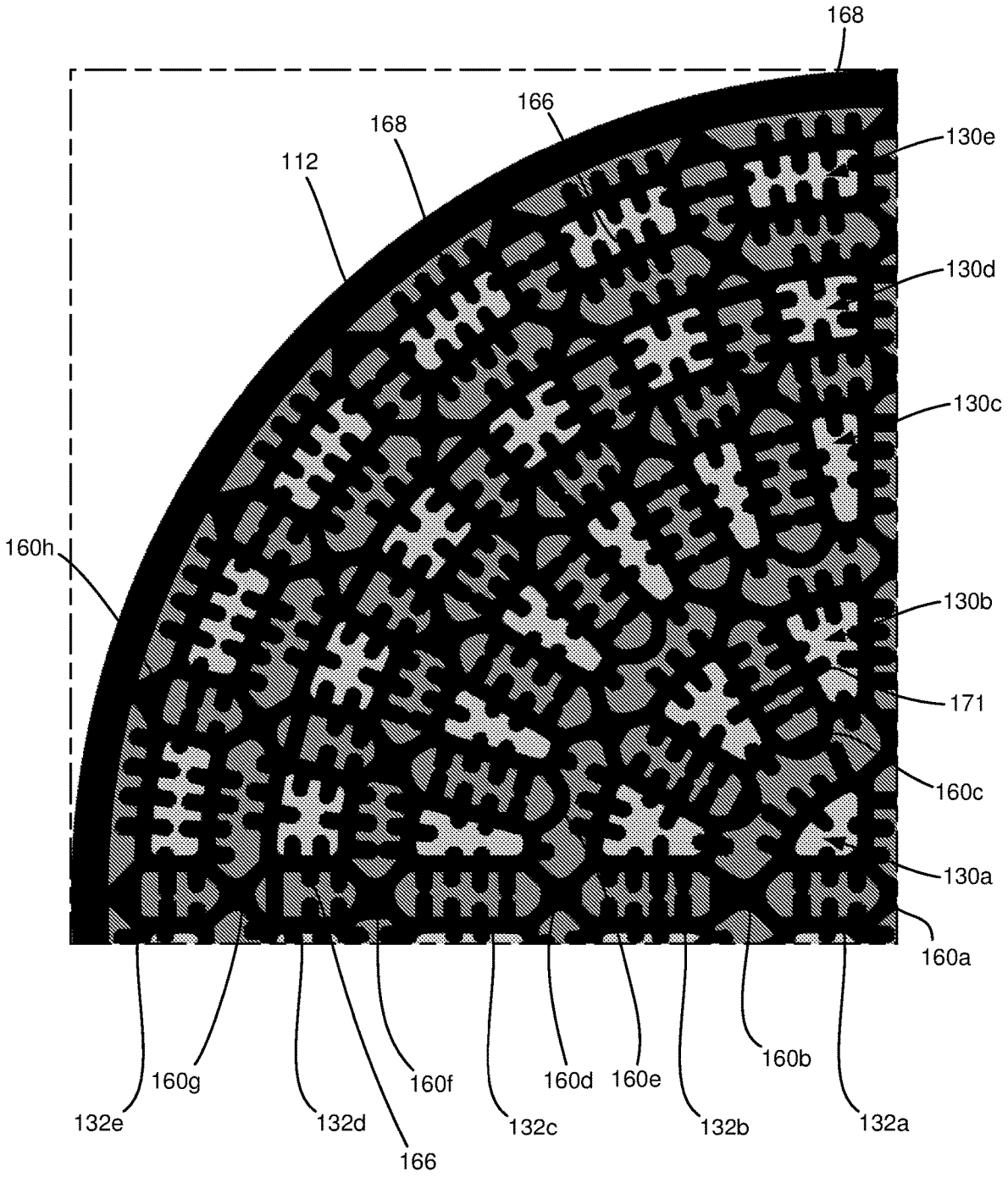
FIG. 38: is an enlarged view of region $Y_2$ in FIG. 36.

FIG. 38 is a partial cross section of the heat exchanger 110 taken through the central core region $M_2$, showing a quadrant of the heat exchanger. In FIG. 18, the outer shell 112, tubes 132, and bridging elements 160 are shown in solid black. The working fluid flow paths are shown in light gray, and the coolant conduits are shown in dark gray.

Figure 24:
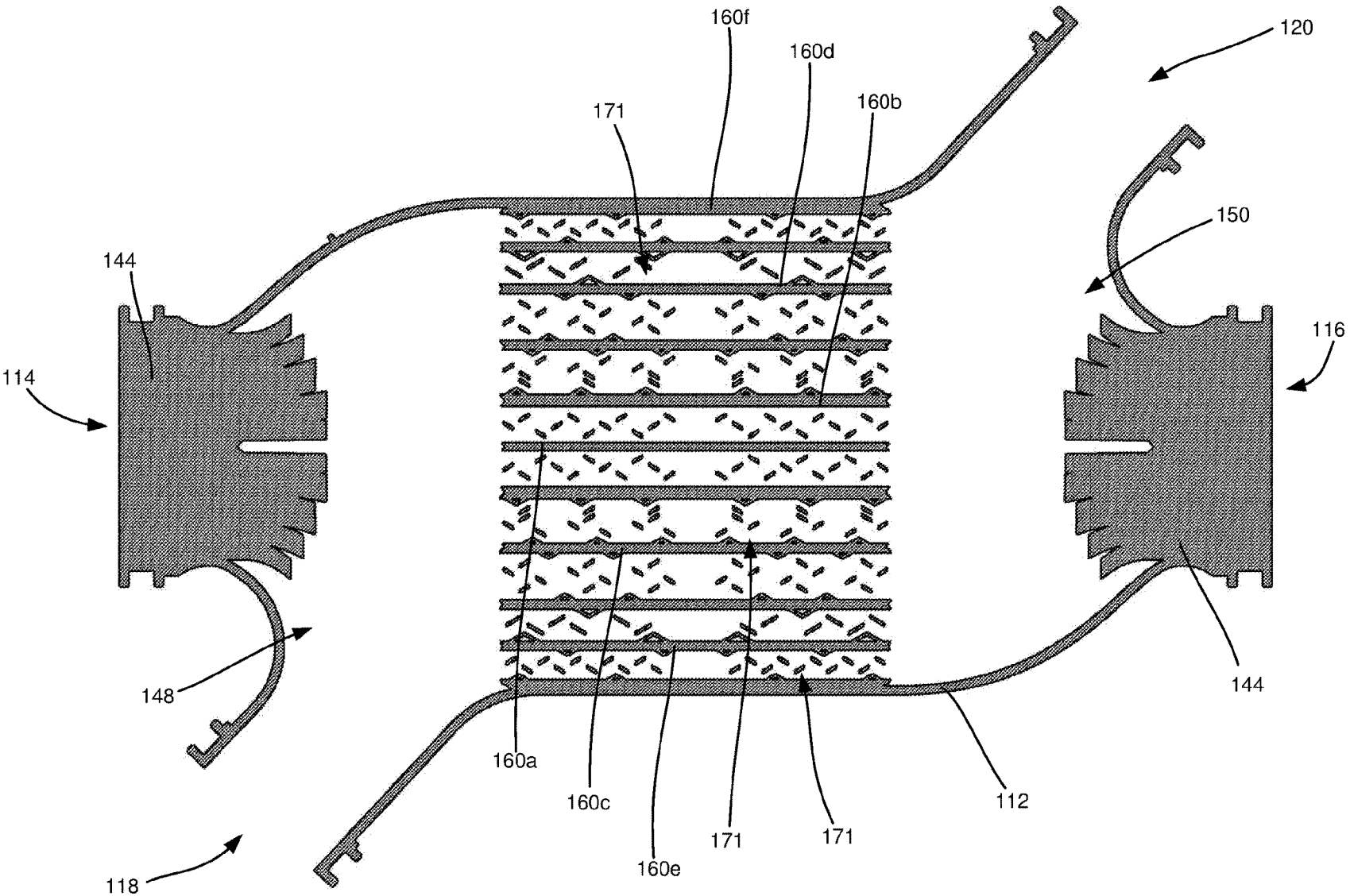
FIG. 24: is a cross section cut of the heat exchanger taken along the line $A_2$-$A_2$ in FIG. 22.
Figure 25:
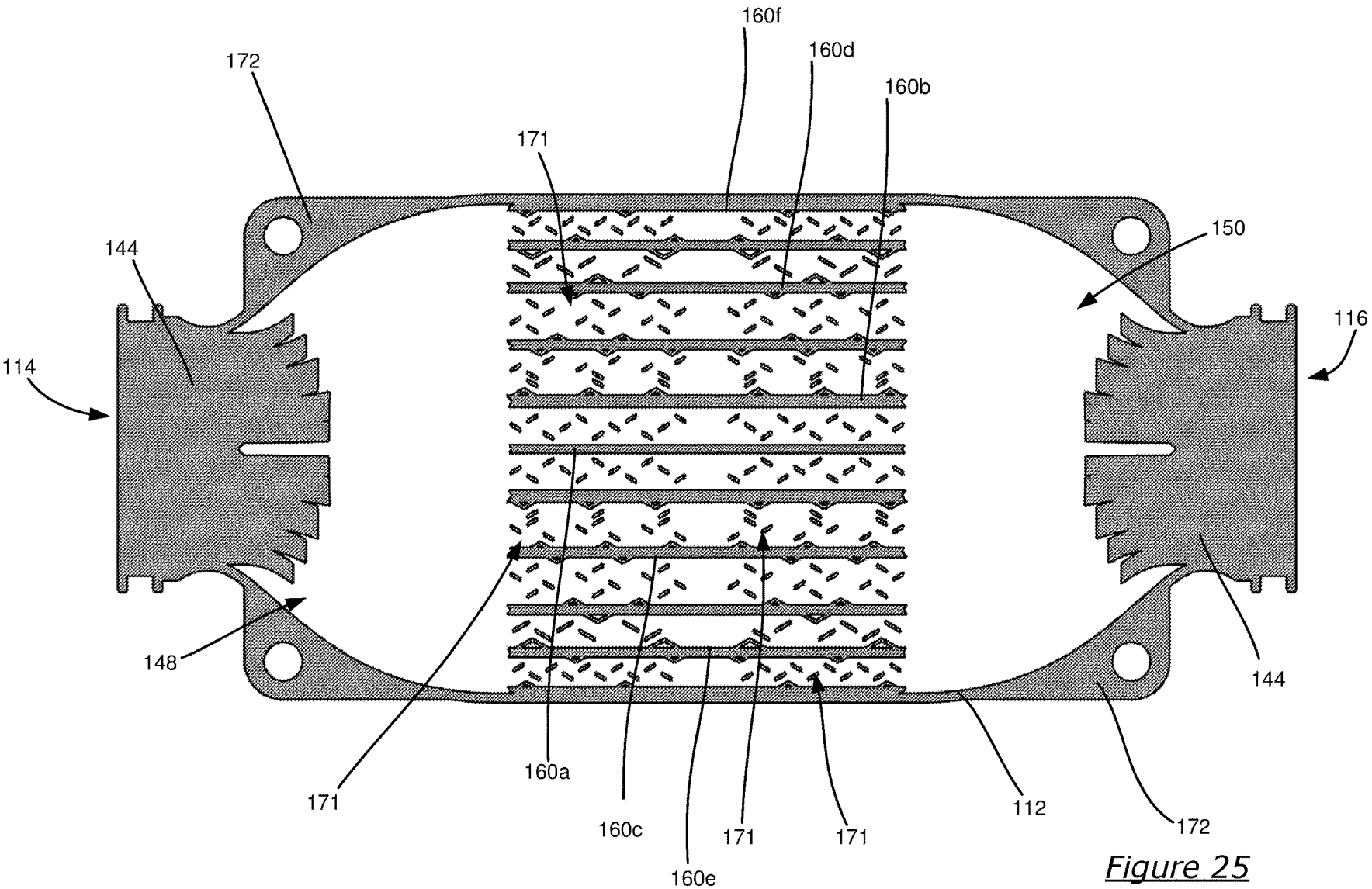
FIG. 25: is a cross section view of the heat exchanger as viewed along the line $B_2$-$B_2$ in FIG. 22.
Figure 26:
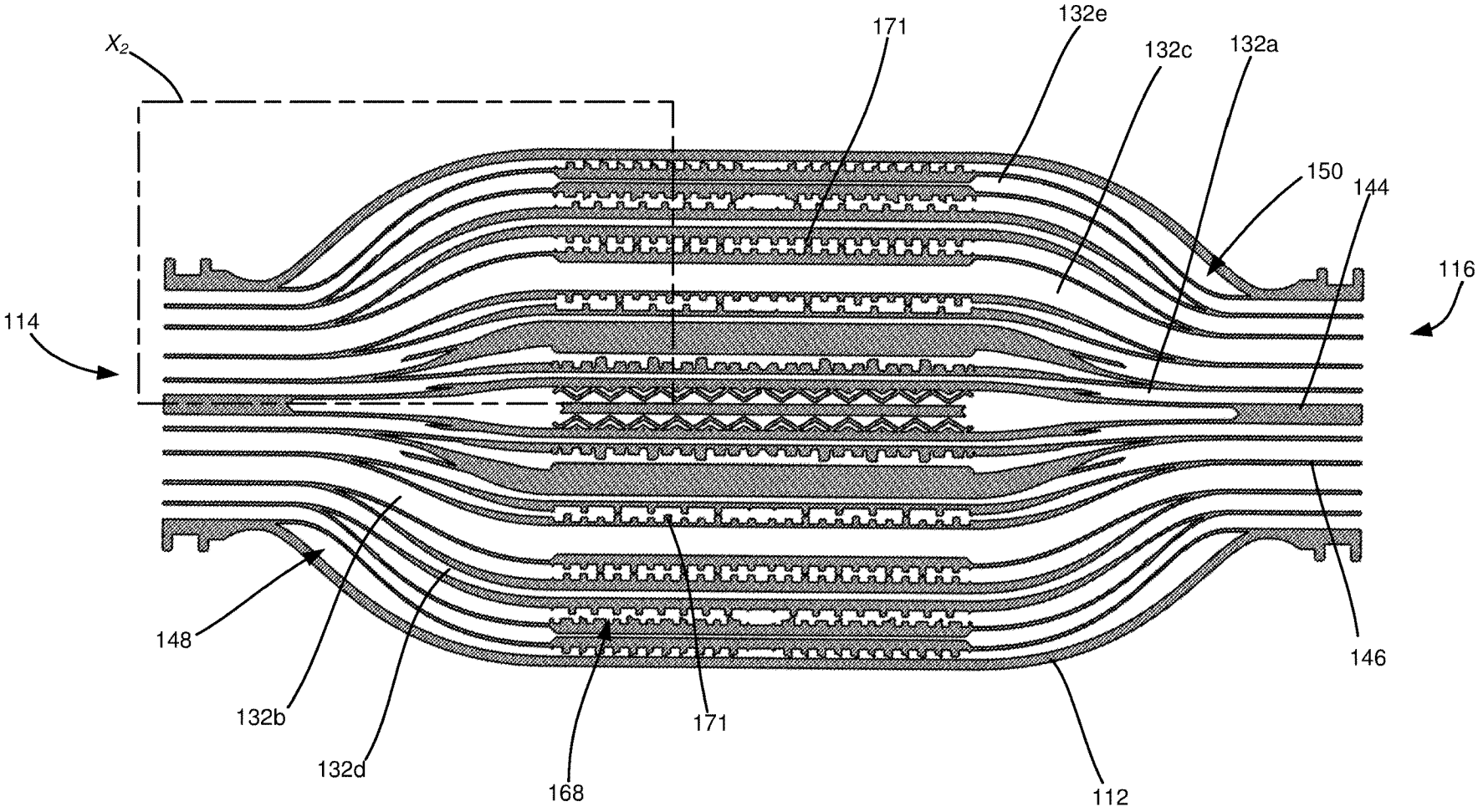
FIG. 26: is a cross section cut of the heat exchanger taken along the line $C_2$-$C_2$ in FIG. 22.
Figure 27:
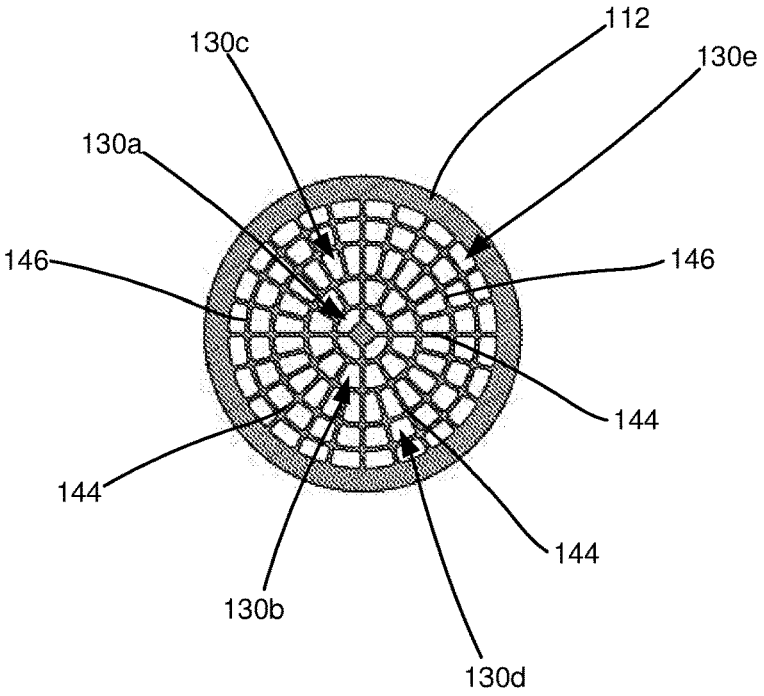
FIG. 27: is a cross section cut of the heat exchanger taken along the line $D_2$-$D_2$ in FIG. 20.
Figure 28:
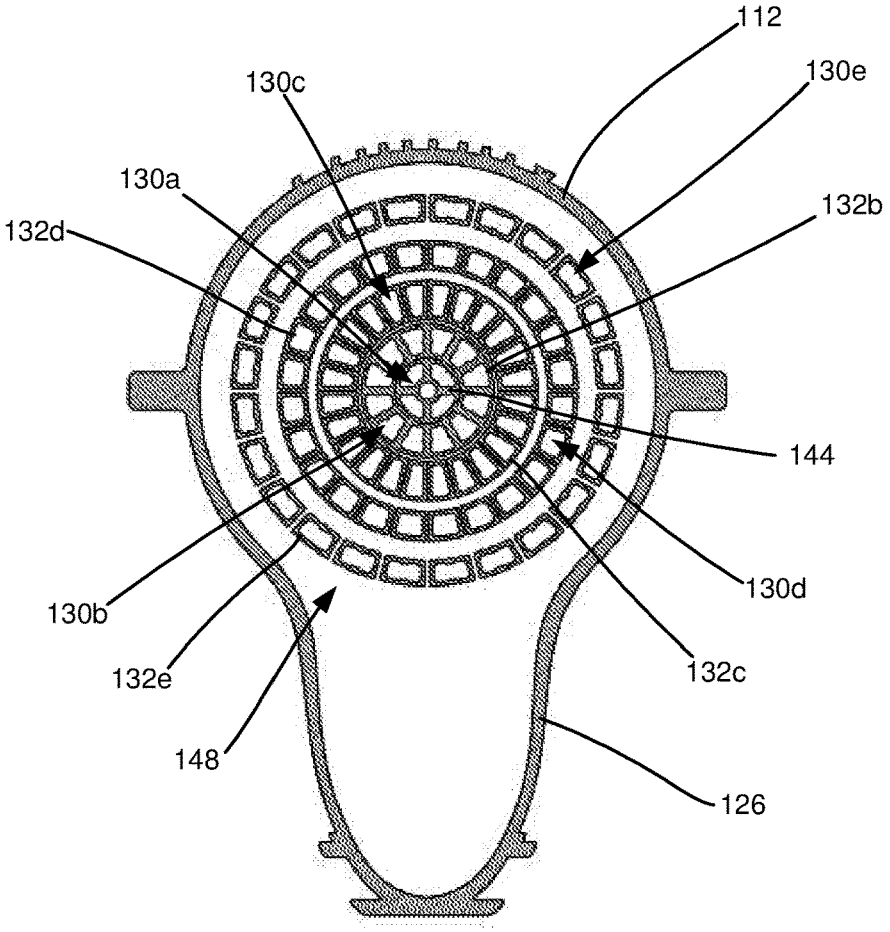
FIG. 28: is a cross section cut of the heat exchanger taken along the line $E_2$-$E_2$ in FIG. 20.
Figure 29:
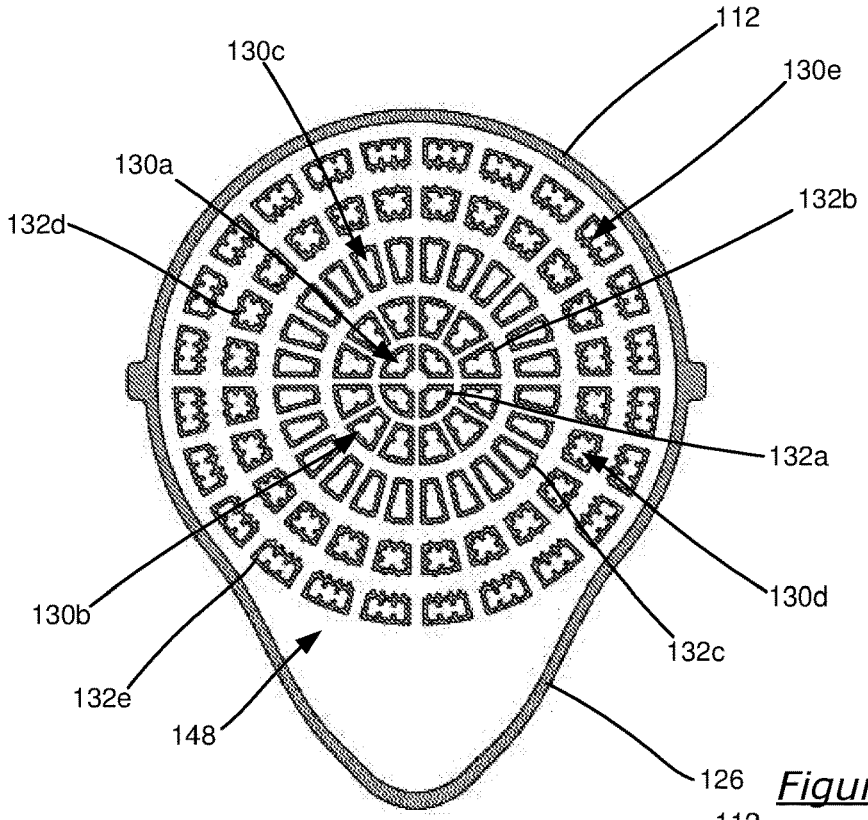
FIG. 29: is a cross section cut of the heat exchanger taken along the line $F_2$-$F_2$ in FIG. 20.
Figure 30:
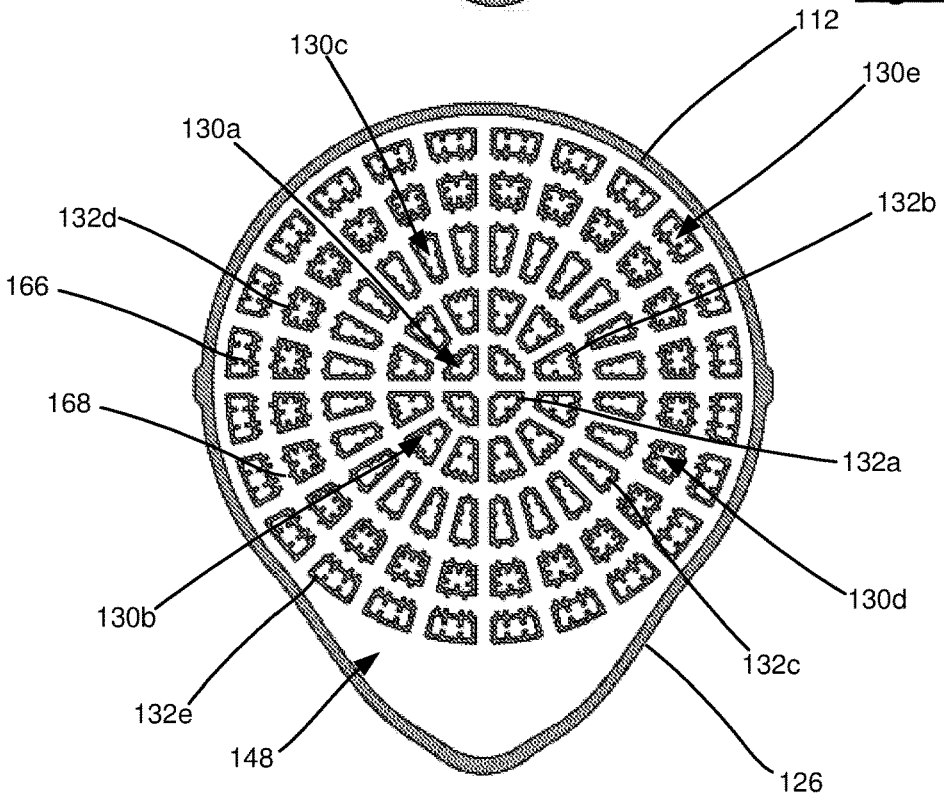
FIG. 30: is a cross section cut of the heat exchanger taken along the line $G_2$-$G_2$ in FIG. 20.
Figure 31:
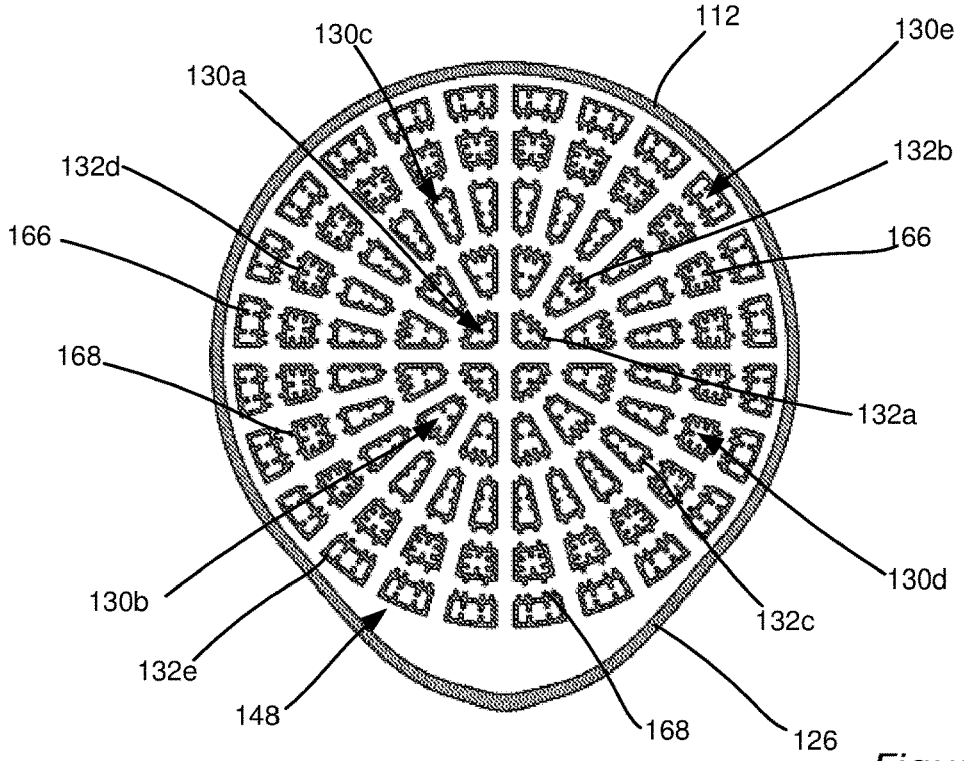
FIG. 31: is a cross section cut of the heat exchanger taken along the line $H_2$-$H_2$ in FIG. 20.
Figure 32:
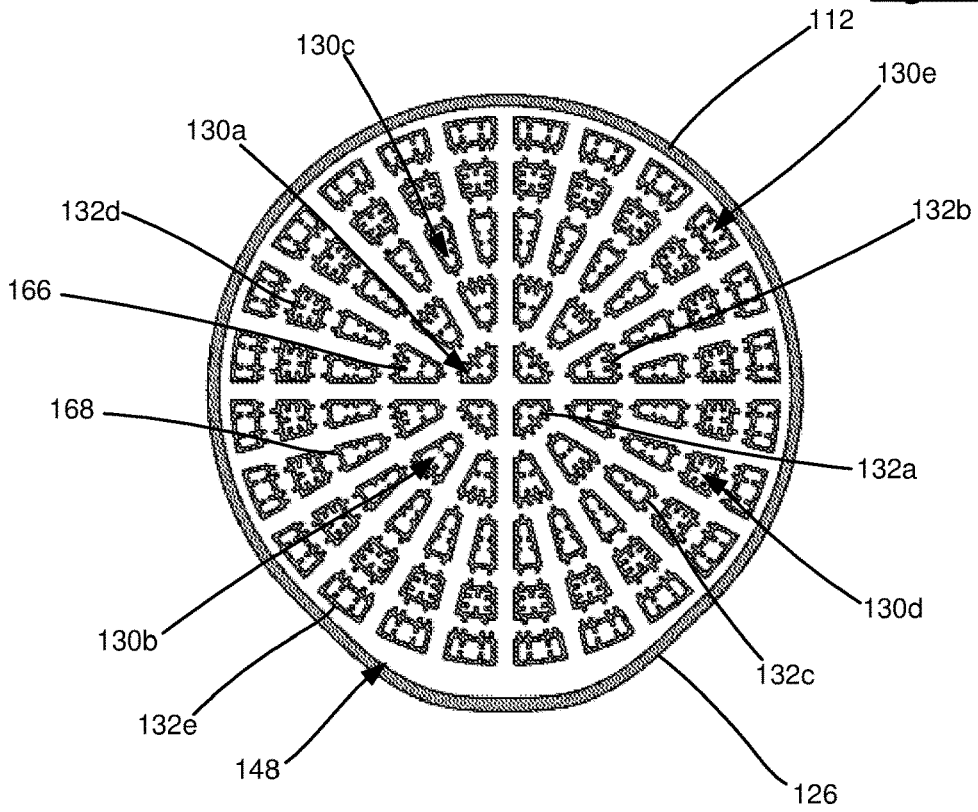
FIG. 32: is a cross section cut of the heat exchanger taken along the line $J_2$-$J_2$ in FIG. 20.
Figure 33:
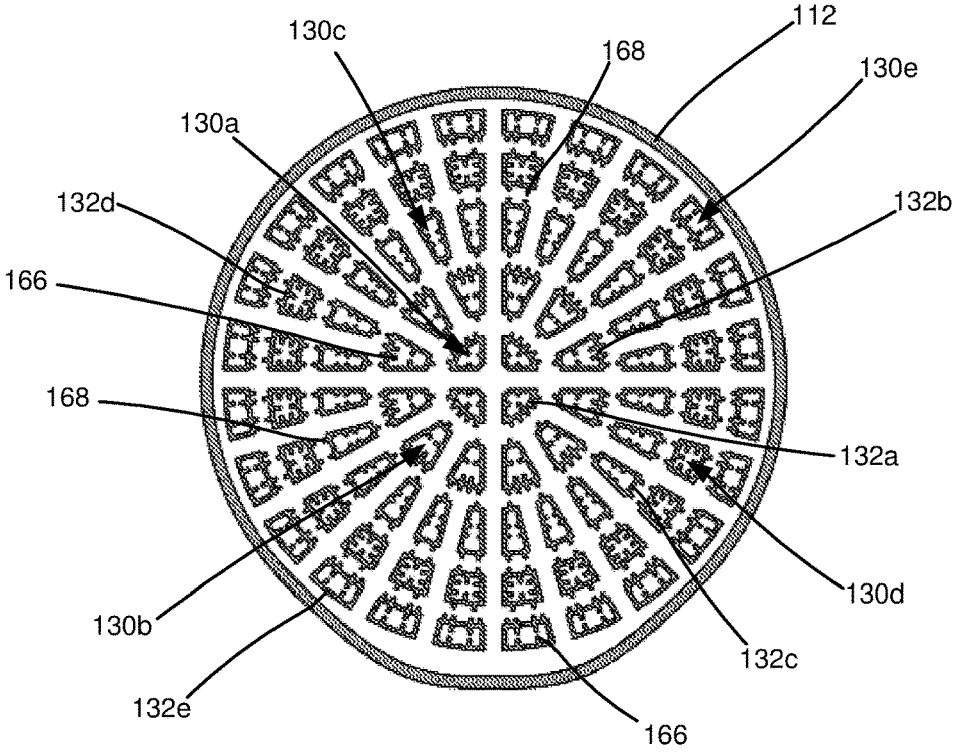
FIG. 33: is a cross section cut of the heat exchanger taken along the line $H_2$-$H_2$ in FIG. 20.
Figure 34:
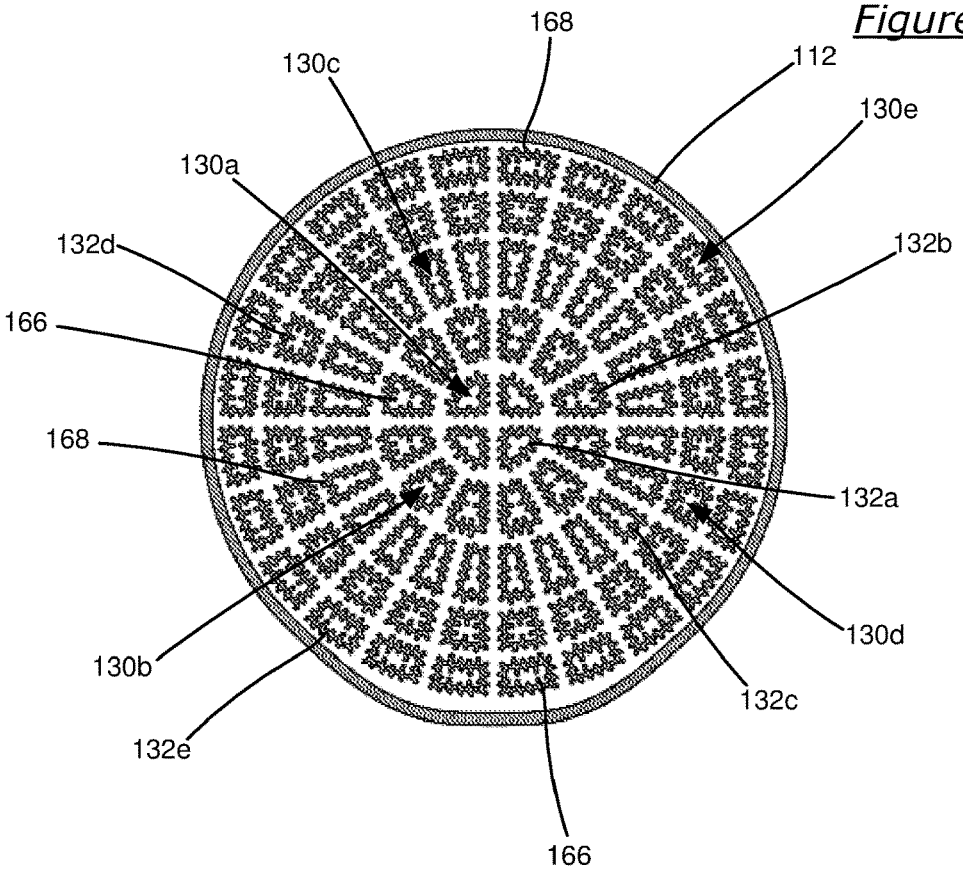
FIG. 34: is a cross section cut of the heat exchanger taken along the line $J_2$-$J_2$ in FIG. 20.
Figure 35:
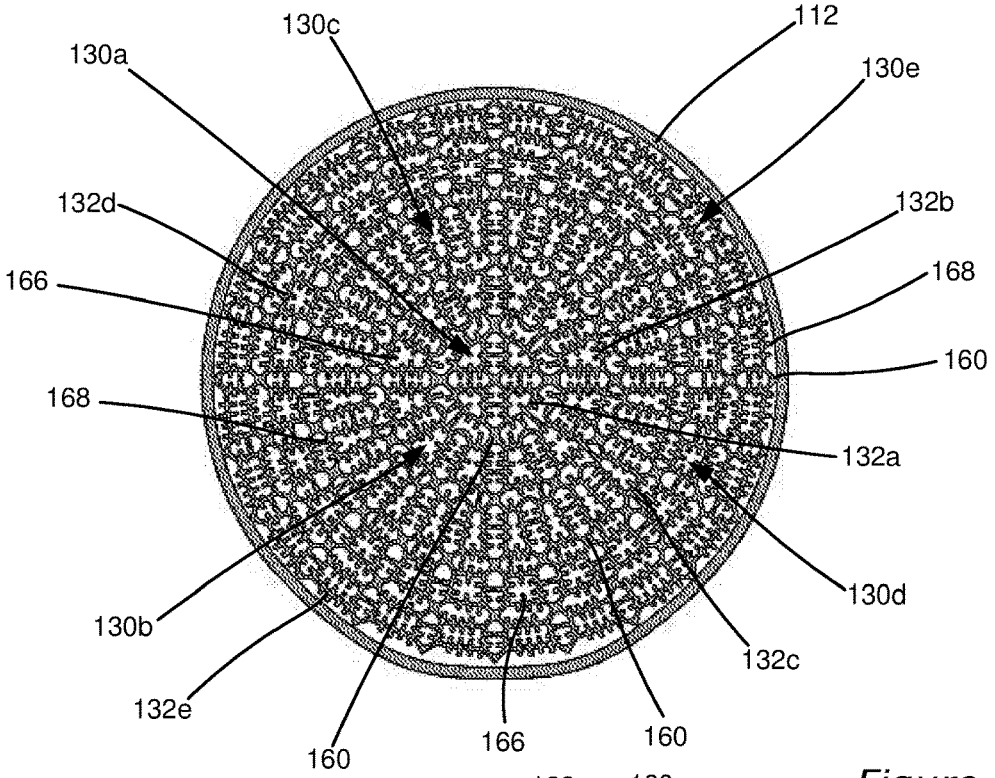
FIG. 35: is a cross section cut of the heat exchanger as viewed along the line $P_2$-$P_2$ in FIG. 20.
Figure 36:
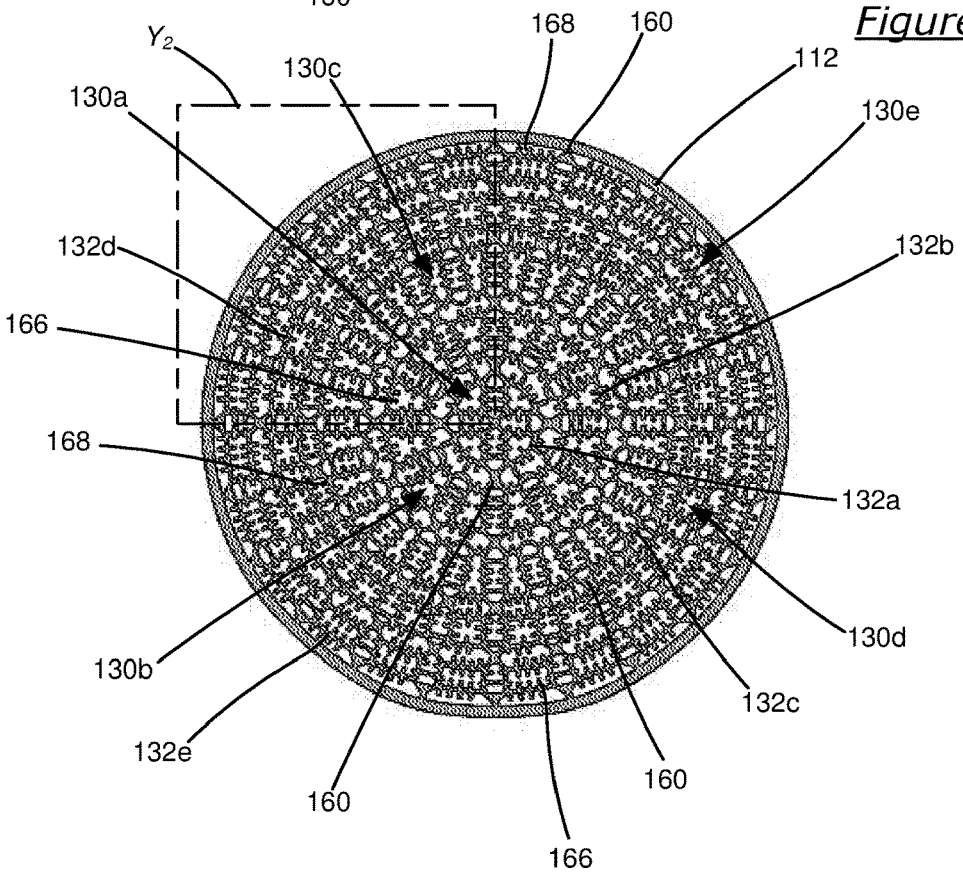
FIG. 36: is a cross section cut of the heat exchanger as viewed along the line $Q_2$-$Q_2$ in FIG. 20.
Figure 37:
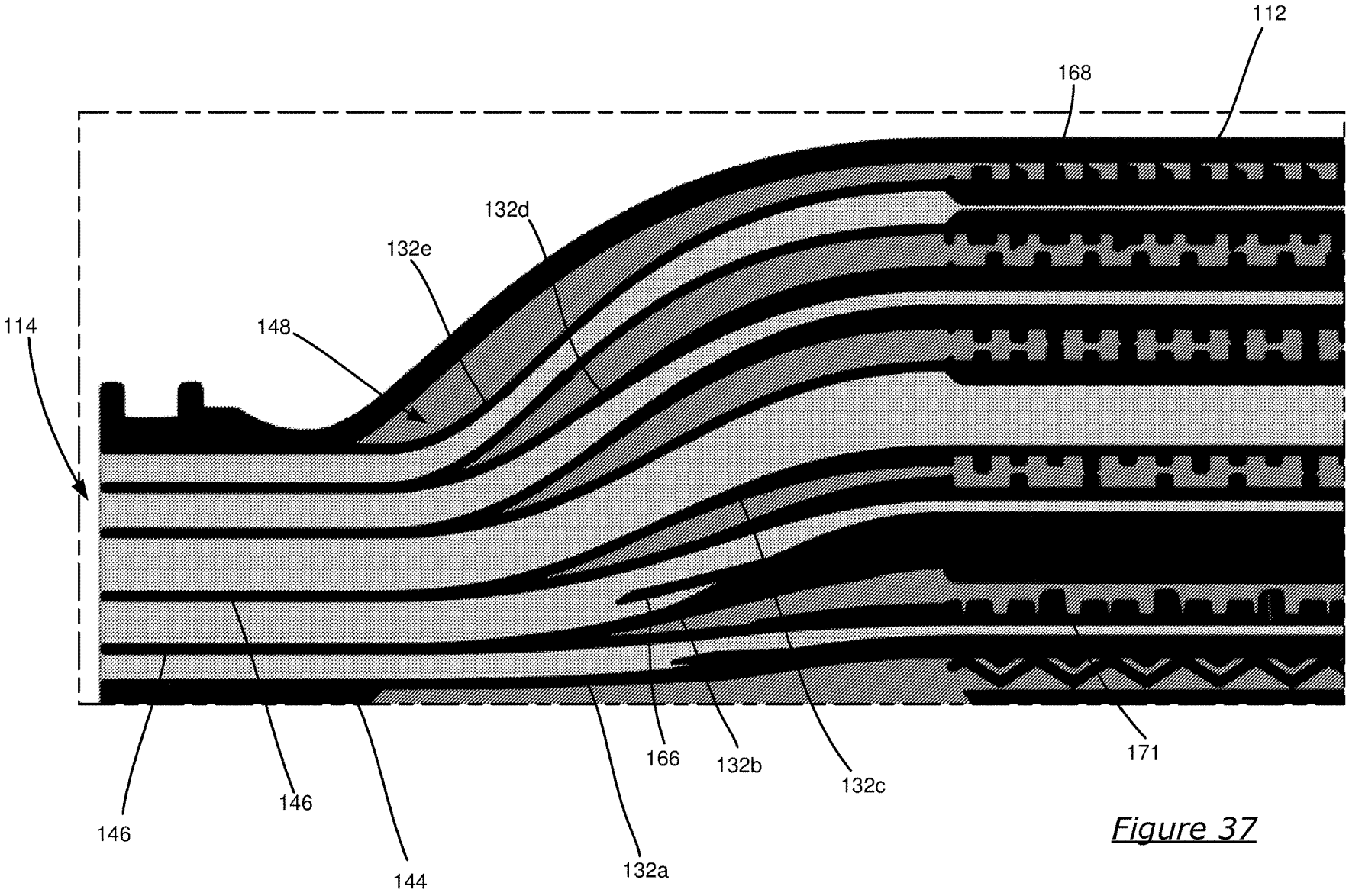
FIG. 37: is an enlarged view of region $X_2$ in FIG. 25.

The bridging elements 160 are shown in FIGS. 24 and 25. In this particular embodiment, the bridging elements 160 include:

- a central bridging element 160*a;*
- four (4) bridging elements 160*b* that extend between the tube dividing walls that define the tubes 132 in the first and second rings 130*a*, 130*b;*
- eight (8) bridging elements 160*c* that extend between certain adjacent pairs of the tube dividing walls that define the tubes 132 in the second ring 130*b;*
- twelve (12) bridging elements 160*d* that extend between the tube dividing walls that define the tubes 132 in the second and third rings 130*b*, 130*c;*
- twelve (12) bridging elements 160*e* that extend between certain adjacent pairs of the tube dividing walls that define the tubes 132 in the third ring 130*c;*
- twenty four (24) bridging elements 160*f* that extend between the tube dividing walls that define the tubes 132 in the third and fourth rings 130*c*, 130*d;*
- twenty four (24) bridging elements 160*g* that extend between the tube dividing walls that define the tubes 132 in the fourth and fifth rings 130*d*, 130*e*; and
- twenty four (24) bridging elements 160*h* that extend between the outer shell 112 and the tube dividing walls that define the tubes 132*e* in the fifth ring 130*e*.

Bridging elements 160*a* to 160*e* have a cross section that is generally cross shaped. The bridging elements 160*f* have a cross section that is generally triangular. These shapes enable the volumetric capacity of the heat exchanger to be maximized, whilst providing suitable geometric stability to the tube dividing walls as described previously.

Heat Transfer Fins:

Each of the tubes 132 has a central portion with heat transfer fins 166 that each project from one of the tube dividing walls into the respective working fluid flow path. Further, each of the tubes 132 has a central portion with heat transfer fins 168 that each project from one of the tube dividing walls into the respective coolant conduit. In this embodiment, these central portions of the tubes 132 are disposed within the central core region $M_2$ of the heat exchanger 110. Further, these central portions of the tubes 132 extend into the first and second transition regions $L_2$, $N_2$.

Within the first and second transition regions $L_2$, $N_2$, the height of the heat transfer fins 166, 168 decrease towards the respective first and second working fluid port 114, 116. End portions of the tubes 132 have smooth surfaces of the tube dividing walls facing the working fluid flow paths and coolant conduits.

The fins 166, 168 increase the surface area in contact with the working fluid and the coolant, which enhances heat transfer through the walls of the tubes 132, and thus between the working fluid and coolant.

Figure 23:
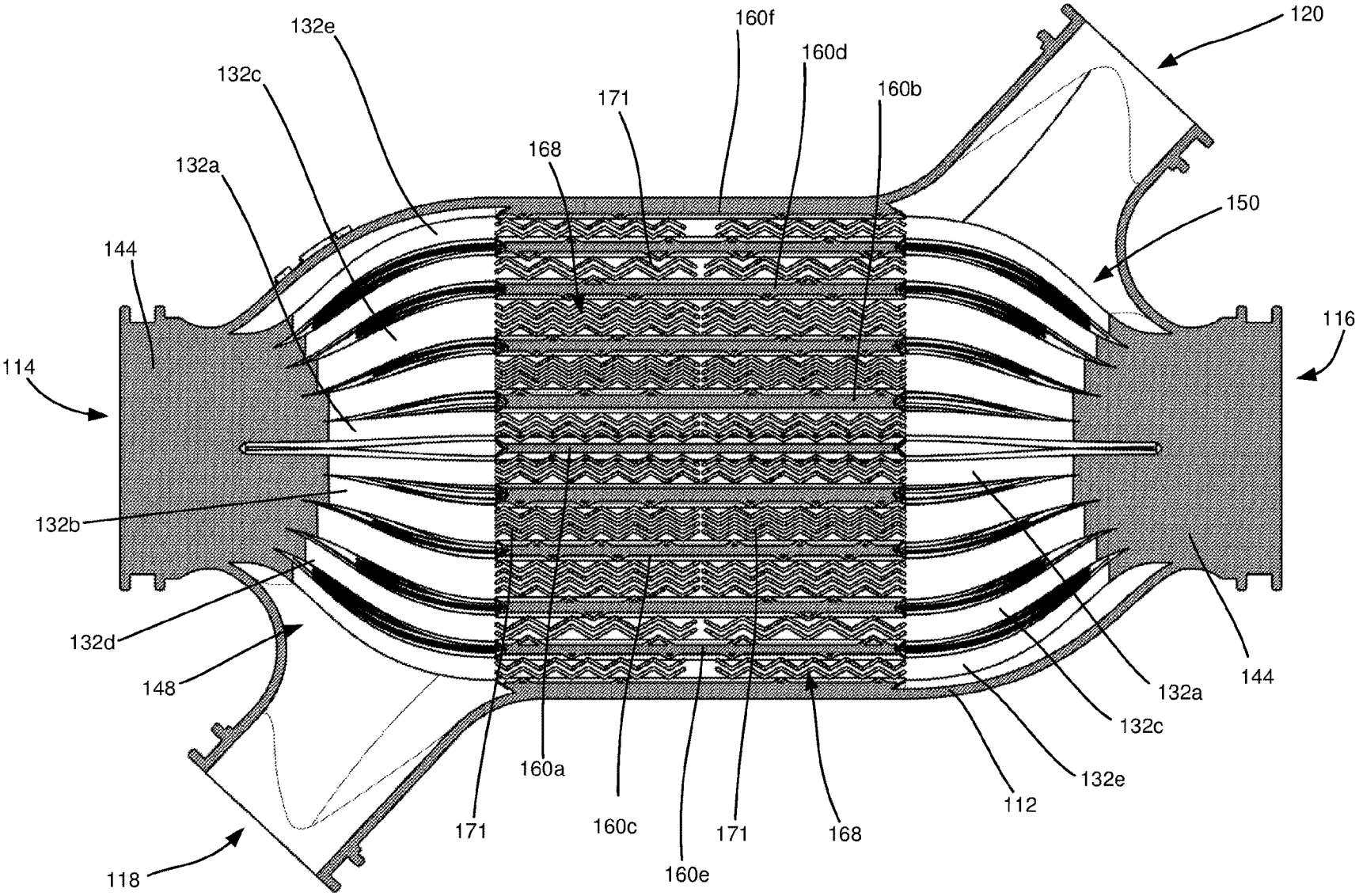
FIG. 23: is a cross section view of the heat exchanger as viewed along the line $A_2$-$A_2$ in FIG. 22.

In this embodiment, the fins 166, 168 have a generally elongate serpentine configuration, as is shown most clearly in FIG. 23. Further, the serpentine configuration is a zig-zag pattern.

Each fin 166, 168 has a castellated structure along its length. In this way, each fin 166, 168 includes parapet formations 171 disposed at intervals along its length and, to either side of each parapet formation 171, the respective fin 166, 168 effectively has a crenel formation. Each parapet formation 171 provides an increase in the height of the respective fin 166, 168 away from the tube dividing wall with respect to the height of the fin 166, 168 in the crenel formation. Further, each parapet formation 171 has a length that is less than the length of the respective fin 166, 168. By virtue of the generally serpentine configuration of the fins 166, 168, the parapet formations 171 extend obliquely (in one or two directions) to the general flow direction of respective working fluid and coolant through the central core region $M_2$ of the heat exchanger 110.

The parapet formations 171 are shown in FIGS. 24 and 25 (these figures being section cuts taken longitudinally through the heat exchanger), but are also visible in FIGS. 23, 26, and 35 to 38.

As shown in FIG. 23, the fins 166, 168 are arranged in sets of two or more fins that are spaced apart in the direction of the respective working fluid flow path or coolant flow path.

The above described structures of the fins 166, 168 minimizes the development of boundary layers in the respective fluid flow. Consequently, the fluid flow within the respective working fluid flow path or coolant conduit has increased turbidity, which encourages mixing of the fluid and enhances transfer of thermal energy to/from the heat exchanger structures.

The heat exchanger 110 is also formed by an additive manufacturing technique. Accordingly, the heat exchanger 110 is jointless and of a seamless unitary component. In other words, the heat exchanger 110 components are continuous and non-interrupted.

A preliminary test, in which a prototype heat exchanger in accordance with an illustrated embodiment was compared with a commercially available benchmark compact heat exchanger, has produced results reflecting a working fluid pressure drop (measured as the differential between the working fluid pressure at the first and second working fluid ports) of approximately 35%, and an improvement of approximately 40% in the logarithmic mean temperature difference, when compared with the benchmark heat exchanger. In addition, the prototype had a dry mass that was approximately 50% of the dry mass of the benchmark heat exchanger.

The logarithmic mean temperature difference is a measure of how effective the exchanger is at transferring heat from the working fluid to the coolant. The working fluid pressure differential is a measure of the resistance of the heat exchanger to flow of working fluid through the device. Consequently, a drop in the working fluid pressure difference represents a reduction in the work required to pump the working fluid through the heat exchanger.

It will be appreciated that in this specification, the distinction between the first and second working fluid ports is predominantly semantic. In some instances, discussion of working fluid flow has been made with reference to these working fluid ports. It will be understood that working fluid flow direction can be reversed, if desired. Similar observations apply in respect of the first and second transition regions, first and second coolant ports, and the first and second coolant manifolds, and the implementation of the heat exchanger to have the fluid from which thermal energy is to be removed flow between the first and second working fluid ports and through the tubes, or between the first and second coolant ports and through the plenum space.

Heat exchangers in accordance with the invention, or any aspect(s) thereof, can be used in many applications, and are not limited to use in engines and motors.

It will be appreciated that the term "fluid" as used in this specification includes liquid and gaseous materials.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The invention claimed is:

1. A heat exchanger for transferring thermal energy between a first working fluid and a second working fluid, the heat exchanger comprising:

an outer shell that has a plurality of openings that include a first port, a second port, a third port, and a fourth port;

a set of tubes that are within the outer shell and each extend completely between the first and second ports, each tube defining a first working fluid flow path through which the first working fluid is to flow; and a plenum space through which the second working fluid is to flow, the plenum space extending within the outer shell and between the third and fourth ports, and including fluid conduits that each at least partly surrounds at least one of the tubes, each fluid conduit defining a second working fluid flow path, wherein the outer shell forms a portion of a tube wall for at least some of the tubes in a region that is adjacent the first port and/or in a region that is adjacent the second port.

2. The heat exchanger of claim 1, wherein at least some of the fluid conduits are defined by the outer shell.

3. The heat exchanger of claim 2, further comprising:

a central core region;

a first transition region that extends between the first port and the central core region; and a second transition region that extends between the second port and the central core region, at least one first portion being provided in the central core region, and second portions being provided in a respective one of the first and second transition regions, and wherein the outer shell defines the respective fluid conduits in the central core region.

4. The heat exchanger of claim 1, further including in a region that is adjacent the first port, one or more tube dividing walls that each form the tube wall for one or more of the tubes.

5. The heat exchanger of claim 3, further comprising one or more tube dividing walls that each form the tube wall for one or more of the tubes in a region that is adjacent the second port.

6. The heat exchanger of claim 5, wherein each tube dividing wall cleaves within the respective first or second transition region, such that within the central core region the tube walls of each first working fluid flow path are exclusive to that first working fluid flow path.

7. The heat exchanger of claim 1, wherein a cross-sectional area of at least some of the tubes varies between the first and second ports.

8. The heat exchanger of claim 7, wherein the heat exchanger has a central core region, a first transition region that extends between the first port and the central core region, and a second transition region that extends between the second port and the central core region, and wherein for at least some of the tubes, a cross-sectional area of each tube is greater within the central core region than a cross-sectional area of the respective tube adjacent the respective first and second ports.

9. The heat exchanger of claim 7, wherein the heat exchanger has a central core region, a first transition region that extends between the first port and the central core region, and a second transition region that extends between the second port and the central core region, and wherein the first working fluid enters the heat exchanger through the first port in a first direction and at least some of the tubes are shaped within the first transition region such that the first working fluid flows outwardly with respect to the first direction, and/or wherein the first working fluid exits the heat exchanger through the second port in a second direction and at least some of the tubes are shaped within the second transition region such that the fluid flows inwardly with respect to the second direction.

10. The heat exchanger of claim 9, wherein the first and second directions are parallel.

11. The heat exchanger of claim 10, wherein the first and second ports are configured such that the first working fluid flows coaxially into and out of the heat exchanger.

12. The heat exchanger of claim 1, wherein at least some tubes include at least one first portion that has one or more fins that each project from one of the tube walls.

13. The heat exchanger of claim 12, wherein the one or more fins each project from one of the tube walls into the second working fluid flow paths, and at least some tubes include one or more second portions in which the surfaces of the tube walls that face the respective second working fluid flow paths are substantially outwardly convex.

14. The heat exchanger of claim 12, wherein the fins have a generally serpentine configuration and are generally elongated with respect to the respective working fluid flow paths.

15. The heat exchanger of claim 12, wherein the fins are arranged in sets of fins, wherein the fins in each set are spaced apart in the direction of the respective working fluid flow path.

16. The heat exchanger of claim 12, wherein the plenum space surrounds the tubes, and wherein the one or more fins each project from one of the tube walls into the respective working fluid flow path, and one or more second portions in which the surfaces of the tube walls that face the respective first working fluid flow paths are substantially inwardly concave.

17. The heat exchanger of claim 16, further comprising a central core region, a first transition region that extends between the first port and the central core region, and a second transition region that extends between the second port and the central core region, the at least one first portion extending at least partly within the central core region, and each of the second portions extending within a respective one of the first and second transition regions.

* * * * *